US010575651B2

(12) United States Patent
Dewert

(10) Patent No.: US 10,575,651 B2
(45) Date of Patent: Mar. 3, 2020

(54) ELECTRIC MOTOR DRIVEN ADJUSTABLE MATTRESS

(71) Applicant: de Werth Group AG, Zürich (CH)

(72) Inventor: Eckhart Dewert, Goldingen (CH)

(73) Assignee: de Werth Group AG, Zürich (CH)

( * ) Notice: Subject to any disclaimer, the term of this patent is extended or adjusted under 35 U.S.C. 154(b) by 300 days.

(21) Appl. No.: 15/665,041

(22) Filed: Jul. 31, 2017

(65) Prior Publication Data

US 2018/0325267 A1 Nov. 15, 2018

(30) Foreign Application Priority Data

May 15, 2017 (DE) ..... 10 2017 110 522
Jun. 26, 2017 (DE) ..... 10 2017 114 091

(51) Int. Cl.

| | |
|---|---|
| ***A61G 7/015*** | (2006.01) |
| ***A47C 20/04*** | (2006.01) |
| ***A47C 20/08*** | (2006.01) |
| ***A47C 27/05*** | (2006.01) |
| ***A47C 27/06*** | (2006.01) |
| ***A47C 27/00*** | (2006.01) |
| ***A47C 27/16*** | (2006.01) |

(52) U.S. Cl.

CPC ..... *A47C 20/041* (2013.01); *A47C 20/08* (2013.01); *A47C 27/002* (2013.01); *A47C 27/05* (2013.01); *A47C 27/053* (2013.01); *A47C 27/06* (2013.01); *A47C 27/16* (2013.01)

(58) Field of Classification Search

CPC ..... A61G 7/015
USPC ..... 5/613, 616–618, 236.1
See application file for complete search history.

(56) References Cited

U.S. PATENT DOCUMENTS

| | | | | |
|---|---|---|---|---|
| 7,386,901 | B2 | 6/2008 | Dewert | |
| 9,877,589 | B2 | 1/2018 | Dewert | |
| 2002/0152552 | A1* | 10/2002 | Dewert | A47C 20/041 5/618 |
| 2003/0052238 | A1 | 3/2003 | Schneider et al. | |
| 2004/0020316 | A1 | 2/2004 | Dewert | |
| 2008/0121852 | A1 | 5/2008 | Koch | |
| 2015/0074908 | A1* | 3/2015 | Dewert | A47C 20/041 5/616 |
| 2016/0015583 | A1 | 1/2016 | Dewert | |
| 2016/0157623 | A1 | 6/2016 | Dewert | |
| 2017/0332798 | A1 | 11/2017 | Dewert | |

FOREIGN PATENT DOCUMENTS

| | | |
|---|---|---|
| DE | 100 46 751 A1 | 5/2001 |
| DE | 100 46 750 C1 | 4/2002 |
| DE | 20 2004 020 384 U1 | 12/2005 |

* cited by examiner

*Primary Examiner* — Fredrick C Conley
(74) *Attorney, Agent, or Firm* — Shlesinger, Arkwright & Garvey LLP

(57) ABSTRACT

An electric motor driven adjustable mattress has a shared casing in which at least one flat cushion element of a cushion structure and an electric motor driven adjustable support apparatus for supporting the cushion element are accommodated. The support apparatus has two support parts that are adjustable relative to one another, and that on their sides facing the cushion element are provided with spring elements for elastically resiliently supporting the cushion element. For adjusting the support parts relative to one another, an electric motor driven drive apparatus is accommodated in the shared casing.

21 Claims, 33 Drawing Sheets

ELECTRIC MOTOR DRIVEN ADJUSTABLE MATTRESS

CROSS-REFERENCE TO RELATED APPLICATIONS

This application claims the priority of German Application No. 10 2017 110 522.0, filed May 15, 2017, and German Application No. 10 2017 114 091.3, filed Jun. 26, 2017, and each of which is incorporated herein by reference.

FIELD OF THE INVENTION

The invention relates to an electric motor driven adjustable mattress.

BACKGROUND OF THE INVENTION

Electric motor driven adjustable support apparatuses for supporting a mattress are generally known. The known support apparatuses have support parts that are adjustable relative to one another by means of an electric motor driven drive apparatus. The known support apparatuses are generally adjustable between a reclined position, in which the support parts together form an essentially horizontal support plane, and a sitting position, in which the support parts are adjusted relative to one another and support a user resting on the mattress, at least in the area of his/her back, to facilitate sitting on the mattress, for example in the bed. The number of support parts of the support apparatus may vary, depending on the particular requirements. The support apparatuses generally have at least one middle support part that is stationary during the adjustment, and an upper body support part that is adjustable relative to the middle support part. The upper body support part itself may have a multi-part design, and may have a back support part and a head and neck support part, for example. Depending on the particular requirements, in addition to the upper body support part a lower body support part may be provided, which at its end facing away from the upper body support part is connected to the middle support part. The lower body support part may also have a multi-part design, and may have a thigh support part and a calf support part, for example.

OBJECTS AND SUMMARY OF THE INVENTION

An object of the invention is to provide a mattress having improved properties, an esthetically pleasing design, and a high level of comfort for a user of the mattress.

This object is achieved by the invention set forth herein.

This object is achieved by the invention set forth in claim 1.

Advantageous and practical further embodiments of claim 1 are set forth in the subclaims.

Further features, properties, and advantages of the invention result from the patent claims, the description, and the drawings.

One embodiment of an electric motor driven adjustable mattress according to the invention is explained in greater detail below with reference to the appended drawings. All features that are described in the description, illustrated in the drawings, and claimed in the patent claims, alone or in any suitable combination with one another, constitute the subject matter of the present invention, regardless of their recapitulation in the patent claims or their back-reference, and regardless of their description or illustration in the drawings. The subject matter of the invention also includes subcombinations of any of the patent claims, in which one feature or multiple features of the particular claim is/are omitted and/or replaced by other features.

Relative terms such as left, right, up, and down are for convenience only and are not intended to be limiting.

DETAILED DESCRIPTION OF THE INVENTION

Figure 1:
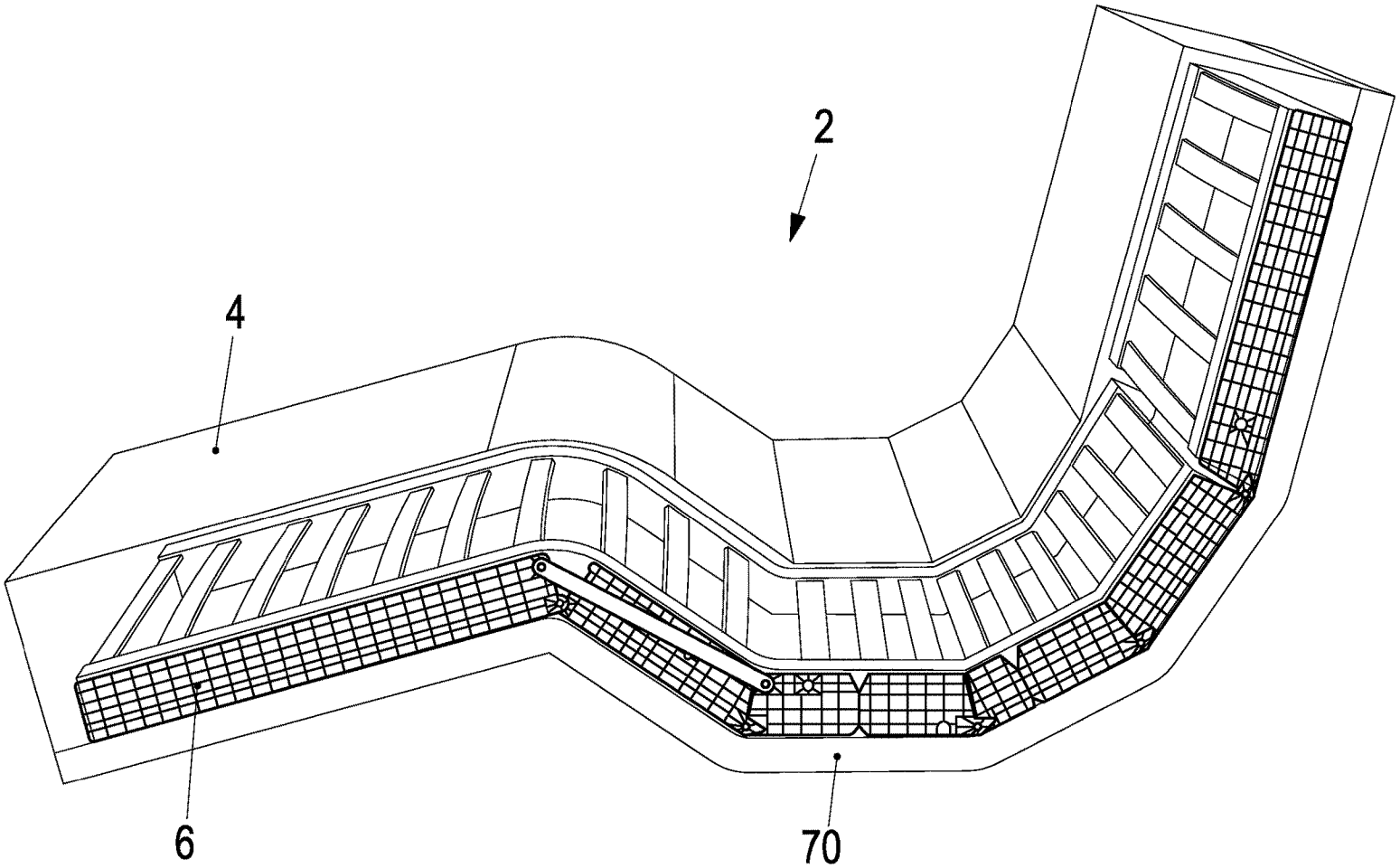
FIG. 1 shows a perspective view, in the manner of a ghosted illustration, of one embodiment of an electric motor driven adjustable mattress according to the invention, in one end position of the adjustment movement that corresponds to a sitting position.

The invention provides a mattress having an integrated adjustment apparatus.

A first embodiment of an electric motor driven adjustable mattress according to the invention is explained in greater detail with reference to FIGS. 1 through 17. Identical components are provided with the same reference numerals in the figures of the drawing; in some figures, individual reference numerals are omitted for reasons of clarity. In addition, individual components are omitted in some figures for purposes of illustration. The missing components should be conceptually added in a corresponding manner.

FIG. 1 shows a perspective view, in the manner of a ghosted illustration, of one embodiment of an electric motor driven adjustable mattress 2 with an integrated electric motor driven adjustment apparatus. The mattress 2 has an overall casing 4 (covering) which is made of a textile material, and which accommodates a flat cushion element and an electric motor driven adjustable support apparatus 6 for supporting the cushion element.

The electric motor driven adjustable support apparatus 6 is explained in greater detail below with reference to FIGS. 3 through 17.

The flat cushion element, which fills the space between the bottom side of the casing 4 and the top side of the support apparatus and essentially completely covers the support apparatus 6, is not illustrated in FIG. 1 for reasons of clarity. The cushion element is made of an elastically resilient material, for example a foam material. Such cushion elements with respect to their design and material are generally known to those skilled in the art, for example from conventional mattresses, and therefore are not explained in greater detail here.

In a manner that is explained in greater detail below, the support apparatus 6 has support parts that are adjustable relative to one another by means of an electric motor driven drive apparatus, likewise explained in greater detail below. FIG. 1 shows the mattress 2 together with the support apparatus 6 in one end position of the adjustment movement that corresponds to a sitting position, and in which the support parts of the support apparatus 6 are pivotably adjusted relative to one another.

Figure 2:
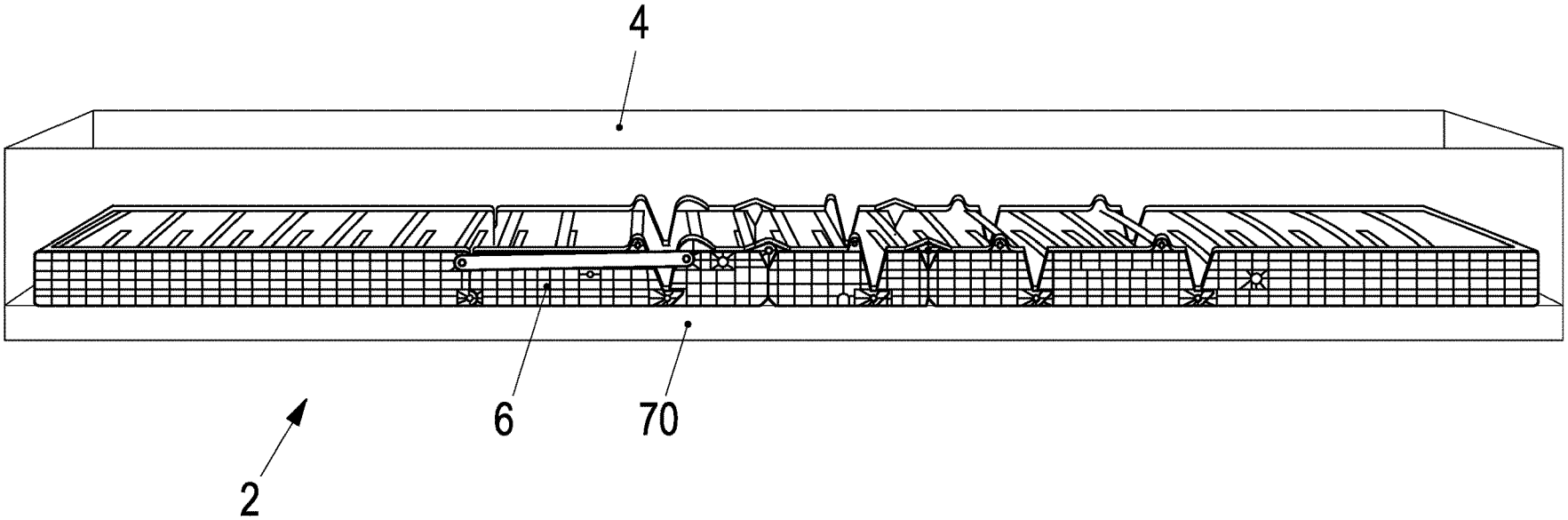
FIG. 2 shows, in the same illustration as FIG. 1, the mattress according to FIG. 1 in the other end position of the adjustment movement, corresponding to a reclined position.

FIG. 2 shows the mattress 2 together with the support apparatus 6 in the other end position of the adjustment movement, which corresponds to a reclined position in which the support parts together span an essentially horizontal support plane.

Figure 3:
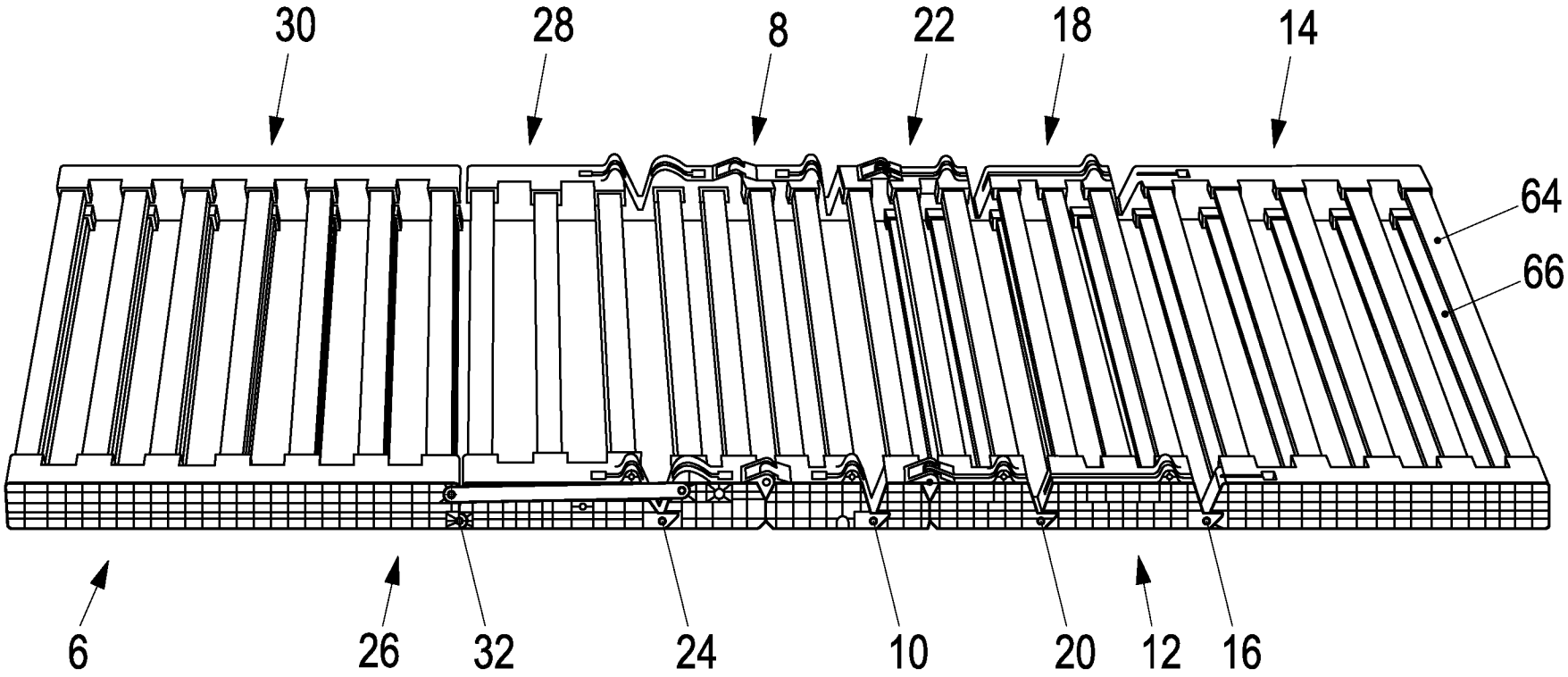
FIG. 3 shows a perspective illustration of a support apparatus of the mattress according to FIG. 1.

FIG. 3 shows the support apparatus 6 by itself, i.e., without the casing 4 and the cushion element, in the reclined position.

Figure 4:
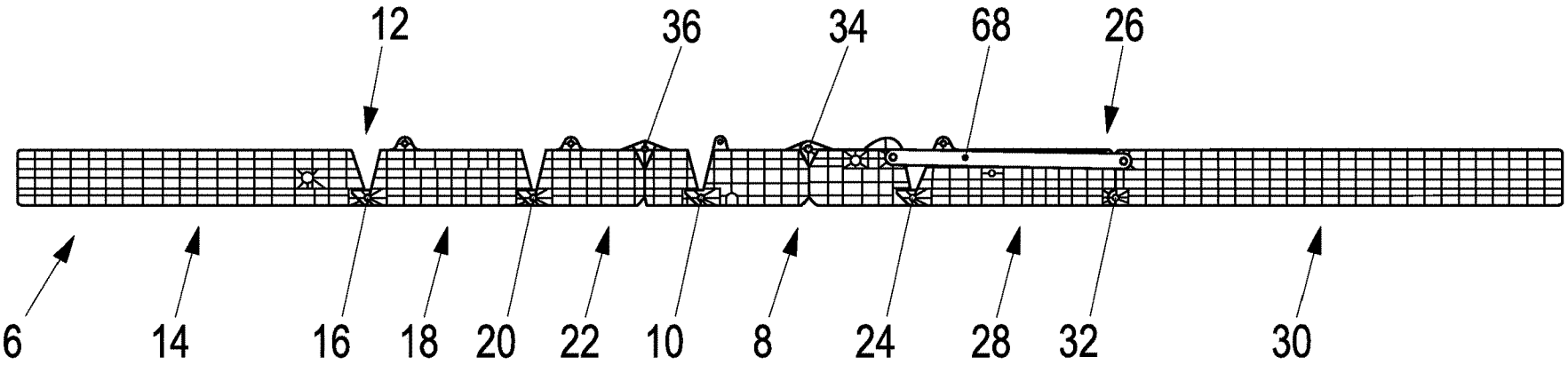
FIG. 4 shows the support apparatus according to FIG. 3 in a side view in the end position of the adjustment movement according to FIG. 2.
Figure 5:
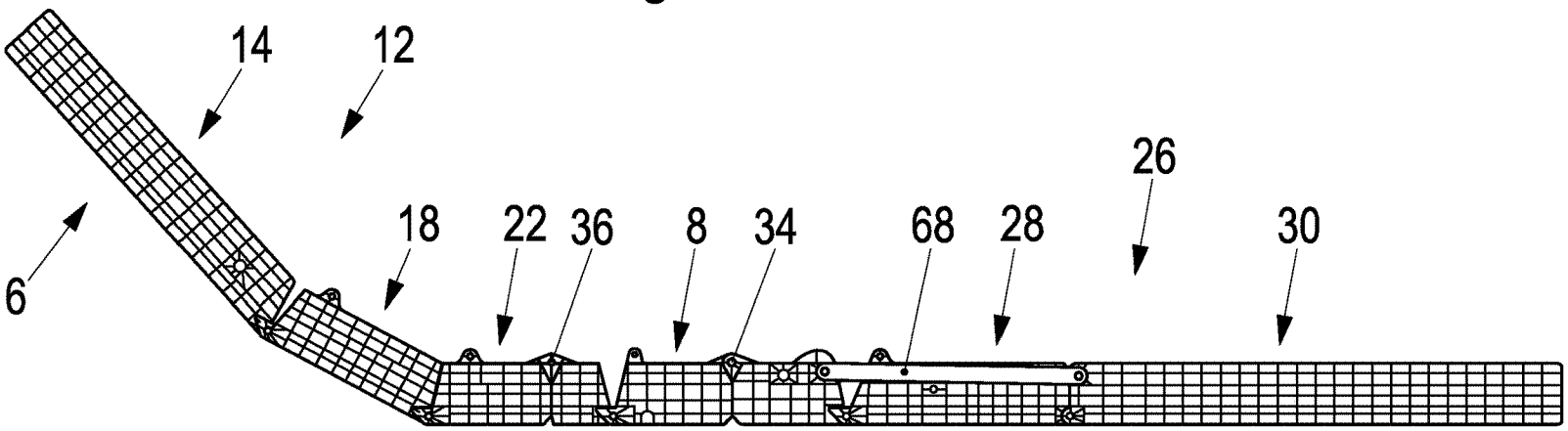
FIG. 5 shows, in the same illustration as FIG. 4, the support apparatus according to FIG. 4, with an upper body support part adjusted.
Figure 6:
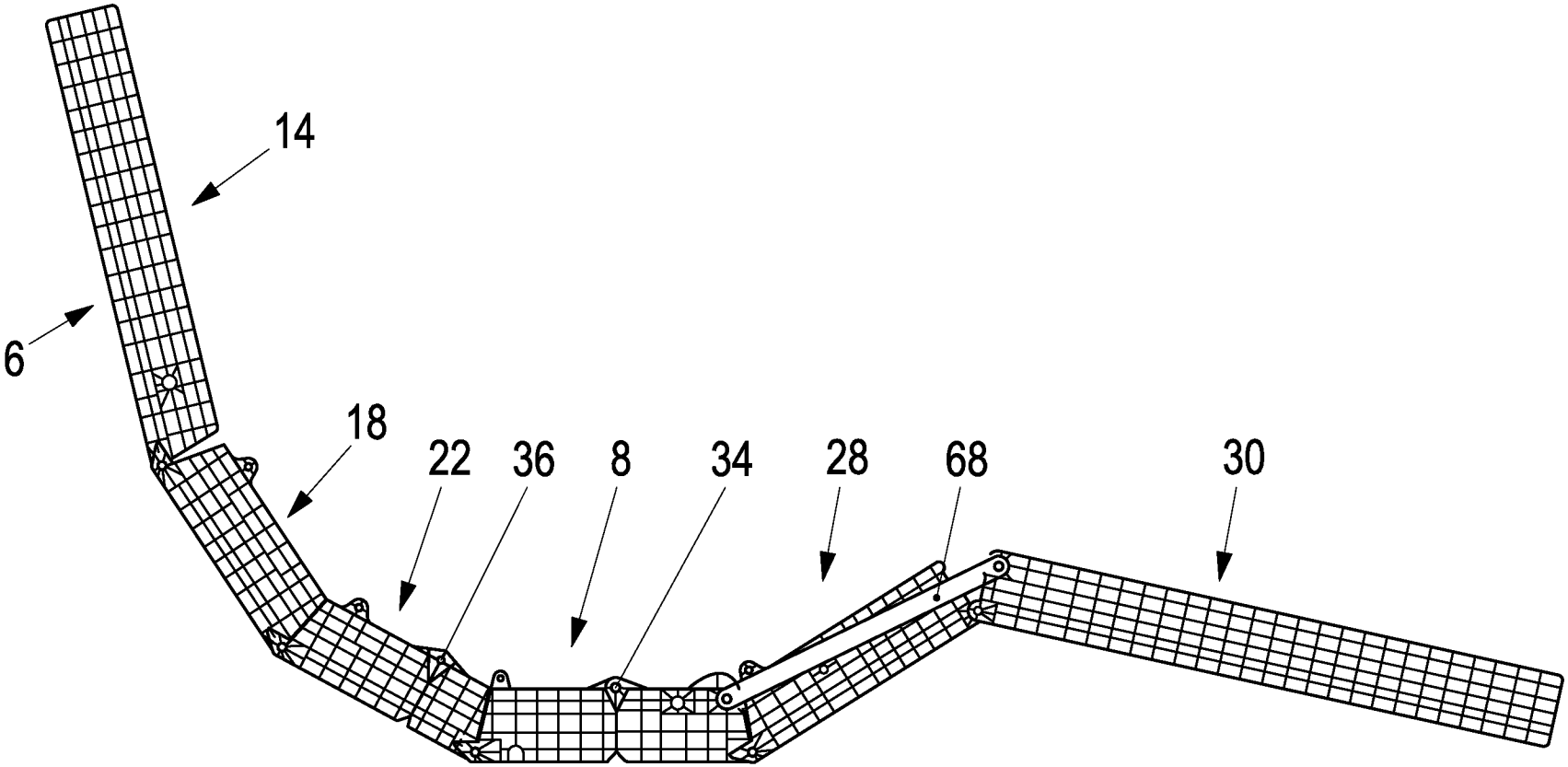
FIG. 6 shows, in the same illustration as FIG. 4, the support apparatus according to FIG. 4, with an upper body support part as well as a lower body support part adjusted.

FIGS. 4 through 6 show the support apparatus 6 in various adjustment positions into which the support parts of the support apparatus 6 may be adjusted relative to one another by means of the electric motor driven drive apparatus.

In the illustrated embodiment, the support apparatus 6 has a middle support part 8 (see FIG. 3) that is stationary during the adjustment, to one end of which an upper body support part 12 is articulatedly connected and pivotable about a horizontal pivot axis 10.

In the illustrated embodiment, the upper body support part 12 has a neck support part 14, to one end of which a back support part 18 is articulatedly connected and pivotable about a horizontal pivot axis 16. At its end facing away from the neck support part 14, the back support part 18 is connected to a pelvis support part 22 and pivotable about a horizontal pivot axis 20, the pelvis support part with its end facing away from the back support part 18 being connected to the middle support part 8 and pivotable about the pivot axis 10.

A lower body support part 26 is articulatedly connected to the end of the middle support part 8 facing away from the pelvis support part 22 so as to be pivotable about a horizontal pivot axis 24; in this embodiment, the lower body support part has a thigh support part 28 and a calf support part 30. One end of the thigh support part 28 is connected to the middle support part 8 so as to be pivotable about the pivot axis 24, while the end of the thigh support part facing away from the middle support part 8 is articulatedly connected to the calf support part 30 so as to be pivotable about a horizontal pivot axis 32.

The pivot axes 10, 16, 20, 24, 32 are parallel to one another, so that the support apparatus 6, starting from the end position of the adjustment movement (reclined position) illustrated in FIG. 4, is adjustable into the other end position of the adjustment movement (sitting position) illustrated in FIG. 6 by pivotably adjusting the support parts.

One its side facing the cushion element, which in the use position of the mattress 2 is the top side, each of the support parts 8, 14, 18, 22, 28, 30 defines a support surface at or on which the cushion element is supported. In the reclined position, the support parts 8, 14, 18, 22, 28, 30 together form an essentially horizontal support plane, while the support parts 8, 14, 18, 22, 28, 30 are pivotably adjusted relative to one another in the sitting position.

FIG. 5 shows an adjustment position in which the lower body support part 26 is unadjusted relative to the middle support part 8, while the upper body support part 12 is adjusted.

Figure 7:
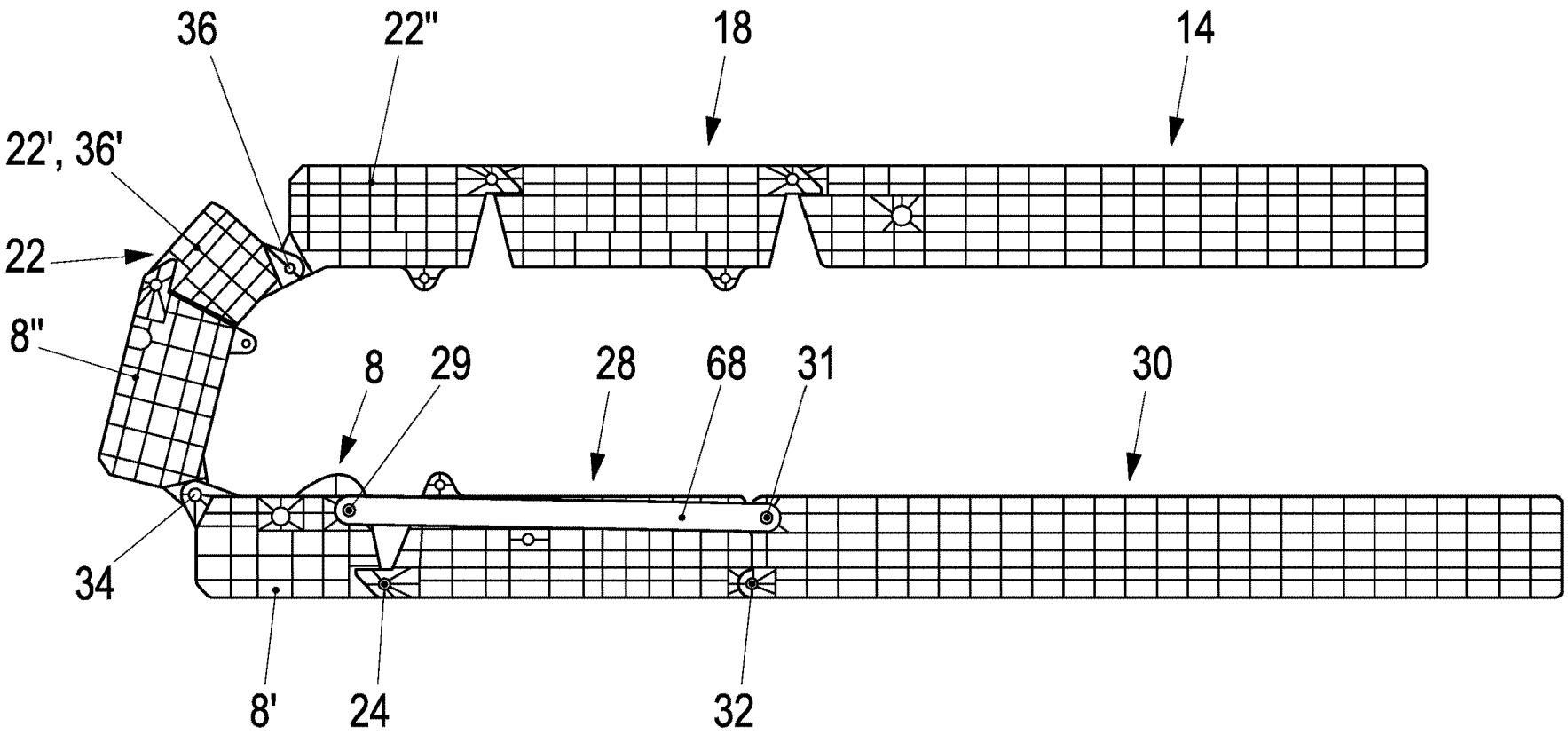
FIG. 7 shows, in the same illustration as FIG. 4, the support apparatus according to FIG. 3 in a folded-up position.

In addition to the pivot axes 10, 16, 20, 24, 32, in this embodiment the support apparatus 6 has two bending and folding axes 34, 36 that are spaced apart from one another in the longitudinal direction of the support apparatus 6 and also with respect to the pivot axes (see in particular FIG. 7). The bending and folding axis 34 is associated with the middle support part 8, and divides it into two individual parts 8, 8', which by means of the bending and folding axis 34 are connected so as to be foldable relative to one another.

The bending and folding axis 36 is associated with the pelvis support part 22, and divides it into two individual parts 22, 22', which by means of the bending and folding axis 36 are connected so as to be foldable relative to one another (see FIG. 7).

It is apparent from FIG. 7 that for folding the mattress, the bending and folding axes 34, 36 are arranged in such a way that the support parts of the support apparatus 6 together with the cushion element situated thereon may be folded together in such a way that the support parts in the folded state of the support apparatus 6 define a U-like cross section. In the folded state of the mattress, and thus in the folded state of the support apparatus 6, the support surfaces of the support parts 22", 18, and 14 on the one hand and the support surfaces of the support parts 8', 28, and 30 on the other hand face one another and are situated essentially parallel to one another.

According to the invention, a bending and folding axis is understood to mean an axis between two support parts that allows the support parts to pivot to the extent that in the folded state of the mattress 2, and thus in the state in which the support parts are folded together, the support surfaces, on which the cushion is supported, of at least two support parts face one another. The bending and folding axis thus allows bending of the support apparatus in order to fold the mattress to reduce its extension in the longitudinal direction and thus make the mattress more compact, and thereby facilitate transport or storage of the mattress. A bending and folding axis may in particular allow pivoting of two support parts, joined together via the bending and folding axis, by 45° or more relative to one another.

For an arrangement of two bending and folding axes, the mattress may, for example, be folded once approximately in the middle in order to reduce its extension in its longitudinal direction by approximately one-half. However, to reduce the extension of the mattress even further in its longitudinal direction, it is also possible by means of a bending and folding axis to fold a first end of the mattress toward the middle, and subsequently, by means of a second bending and folding axis, to fold the other end of the mattress, likewise toward the middle and thus over the first end.

In the folded state of the support apparatus 6, the mattress 2 is folded and forms a compact and therefore easily transportable storage and transport unit. Due to the folding mechanism provided according to the invention, the mattress 2 may in particular be folded up so compactly that it may be shipped via standard postal or courier delivery, thus dispensing with expensive, time-consuming transport by a freight forwarding service.

As is apparent from FIGS. 4 through 7, the bending and folding axes 34, 36 are situated in the direction perpendicular to the support plane, i.e., in the vertical direction, at the end facing the cushion element, i.e., at the top of the support apparatus 6, while the pivot axes 10, 16, 20, 24, 32 are situated in the direction perpendicular to the support plane at the end facing away from the cushion element, i.e., at the bottom of the support apparatus 6.

Figure 8:
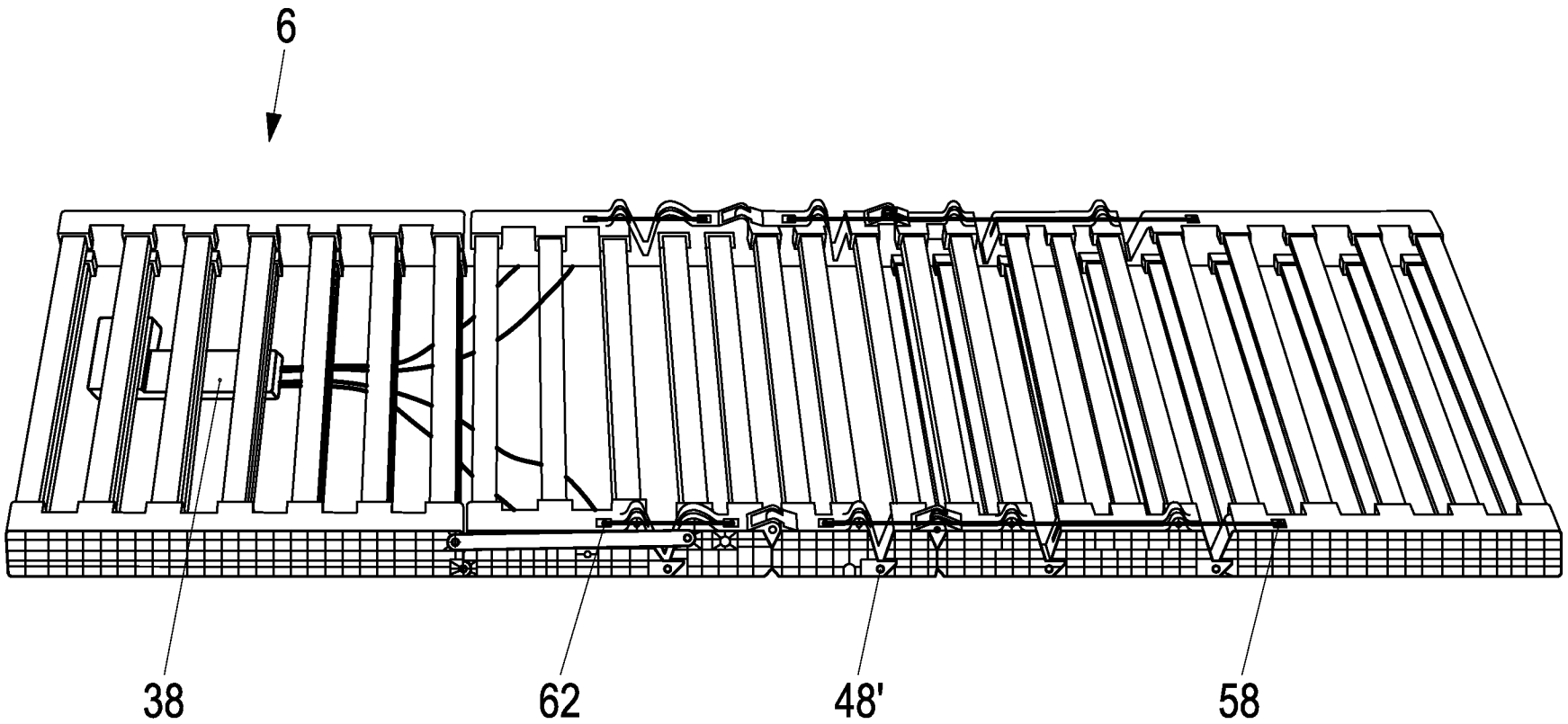
FIG. 8 shows a perspective view of the support apparatus according to FIG. 3.

FIG. 8 shows the support apparatus 6 in a perspective view. An electric motor driven drive apparatus 38 is provided for adjusting the support parts of the support apparatus 6 relative to one another, as explained in greater detail below.

The electric motor driven drive apparatus 38 has an output element which on the one hand is in drive connection with at least one electric motor, and which on the other hand is operatively connected to four Bowden cables 40', 40", 42', 42" (see FIG. 11), which are operatively connected to the associated support parts in such a way that the particular support parts are adjustable or adjusted relative to one another under the traction effect of the respective Bowden cables.

In the illustrated embodiment, the Bowden cables 40', 40" are associated with the lower body support part 26 for adjusting same relative to the middle support part 8, while the Bowden cables 42', 42" are associated with the upper body support part 12 for adjusting same relative to the middle support part 8.

For actuating the Bowden cables 42', 42", 40', 40", a shared single electric motor 84 is provided which is situated in a housing 44 (motor box, see FIG. 11 and FIG. 15) of the electric motor driven drive apparatus 38, and which via a worm gear is in rotary drive connection with a rotatably supported threaded spindle 86 on which a spindle nut 46, which forms the linearly movable output element of the electric motor driven drive apparatus 38 (see FIG. 15B), is situated in a rotatably fixed manner and is linearly movable in the axial direction of the threaded spindle 86.

Figure 15A:
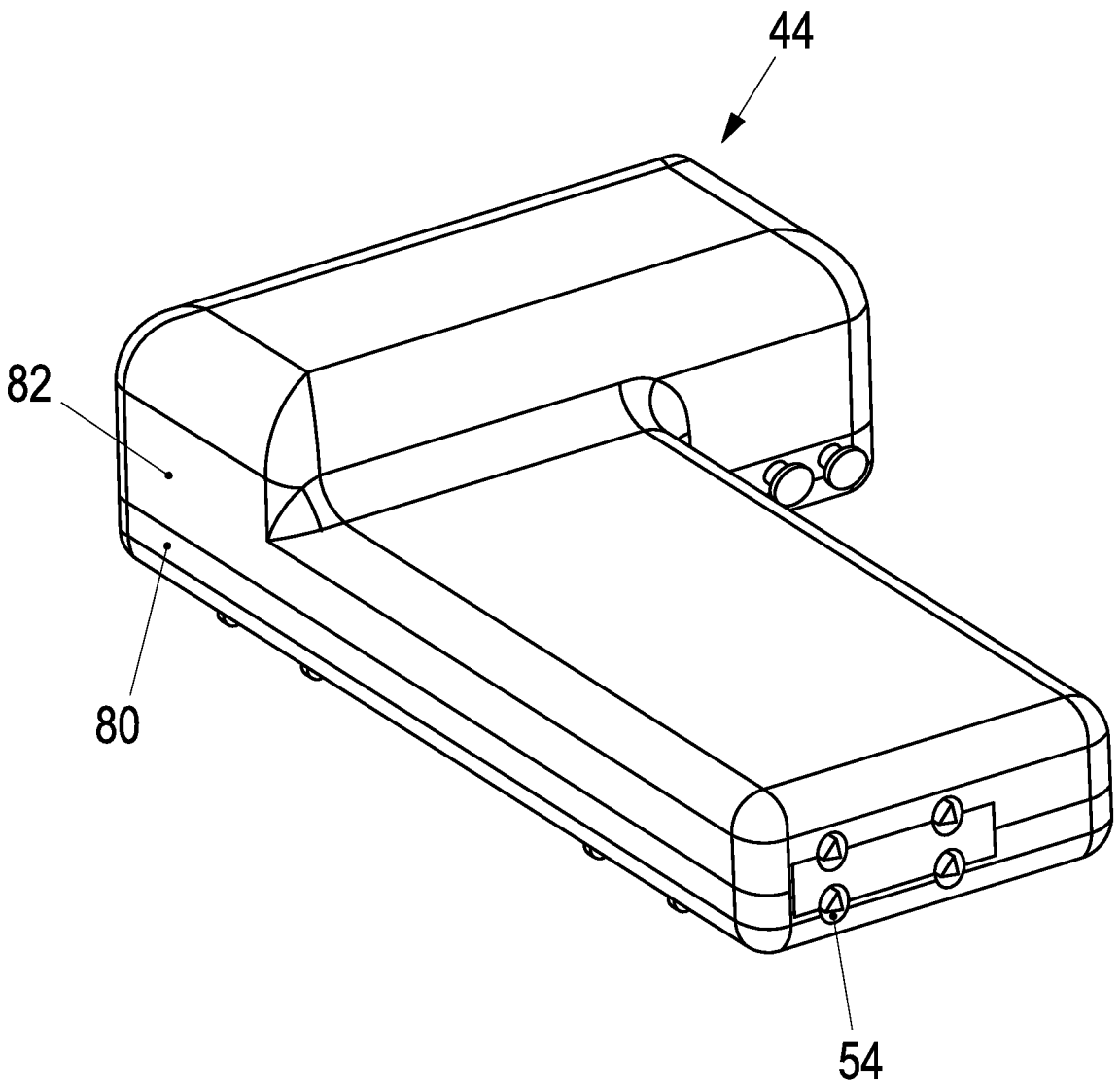
FIG. 15A shows a schematic perspective view of a motor box of an electric motor driven drive apparatus of the support apparatus according to FIG. 8.

FIG. 15A shows the housing 44, made up of two half-shells 80, 82 designed as plastic injection-molded parts, in the closed state. The housing 44 is sealed off from entry of liquid or moisture by a sealing means having at least one seal.

Figure 15B:
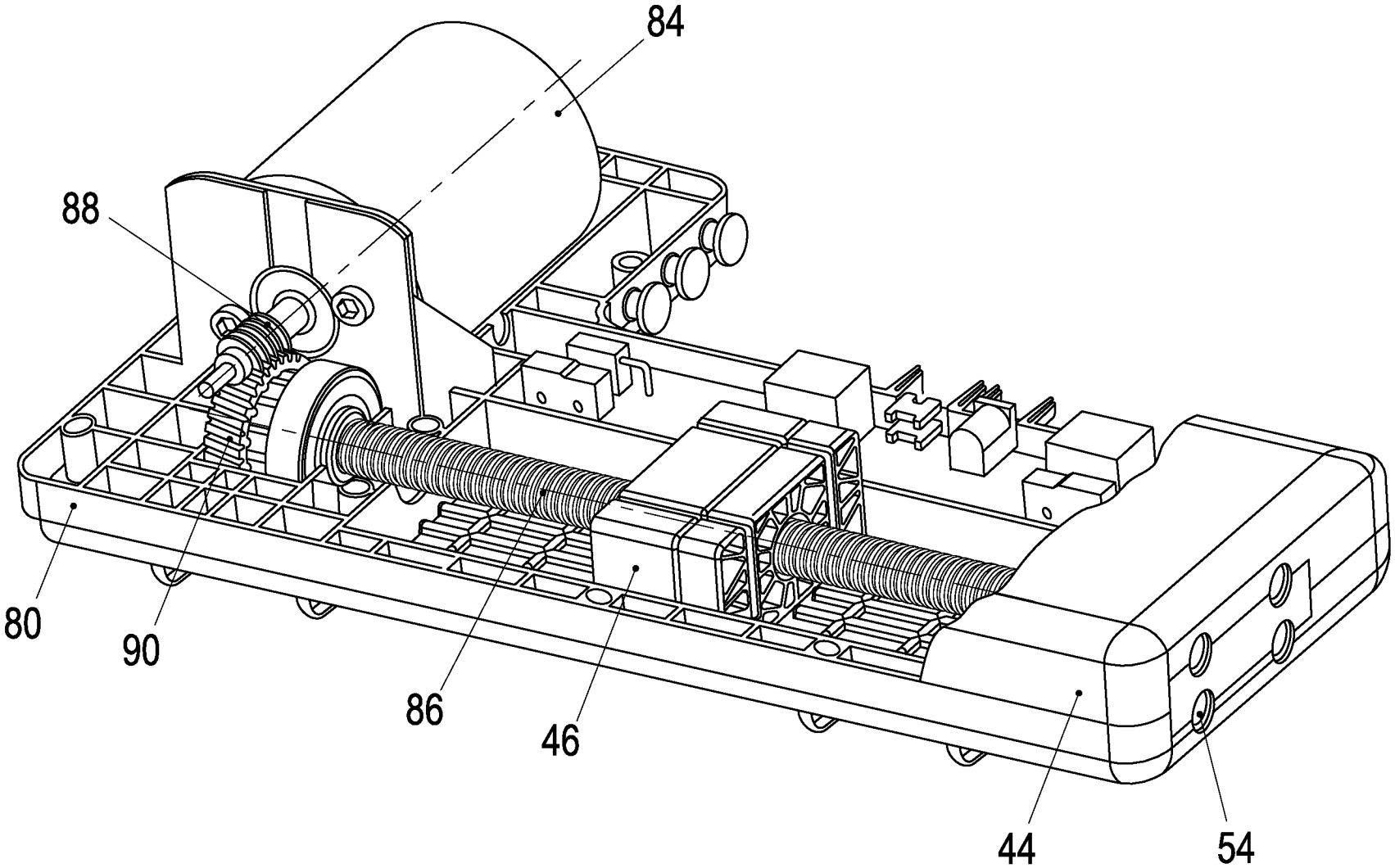
FIG. 15B shows, for clarifying the structure of the electric motor driven drive apparatus, the motor box according to FIG. 15A with the housing cover removed.

FIG. 15B shows the housing 44 with the top half-shell 82 (housing cover) removed. A single shared electric motor 84 that is in drive connection with the spindle nut 46 is accommodated in the housing 44. The spindle nut is part of a spindle drive whose threaded spindle 86 is stationarily situated in the housing 44 and is in rotary drive connection with the electric motor 84. In the illustrated embodiment, the rotary drive connection between the electric motor 84 and the threaded spindle is established via a worm gear, whose worm 88 is integrally formed on the output shaft of the electric motor 84 and is engaged with a worm wheel 90 that is connected to the threaded spindle 86 in a rotatably fixed manner. A ball bearing is provided for the rotary bearing of the threaded spindle 86 in the housing 44.

The spindle nut 46 is situated on the threaded spindle 86 so as to be movable in the axial direction, and is secured against rotation by means of a linear guide that is molded into the lower half-shell 80 of the housing 44. For supplying power and controlling the electric motor 84, power supply and control means are provided, whose design is generally known to those skilled in the art and therefore is not explained in greater detail here, and also not shown. Depending on the selected rotational direction of the output shaft, the threaded spindle 86 rotates in such a way that the spindle nut 46 moves linearly in one direction or the other in order to actuate the Bowden cables 40', 40", 42', 42".

Figure 16:
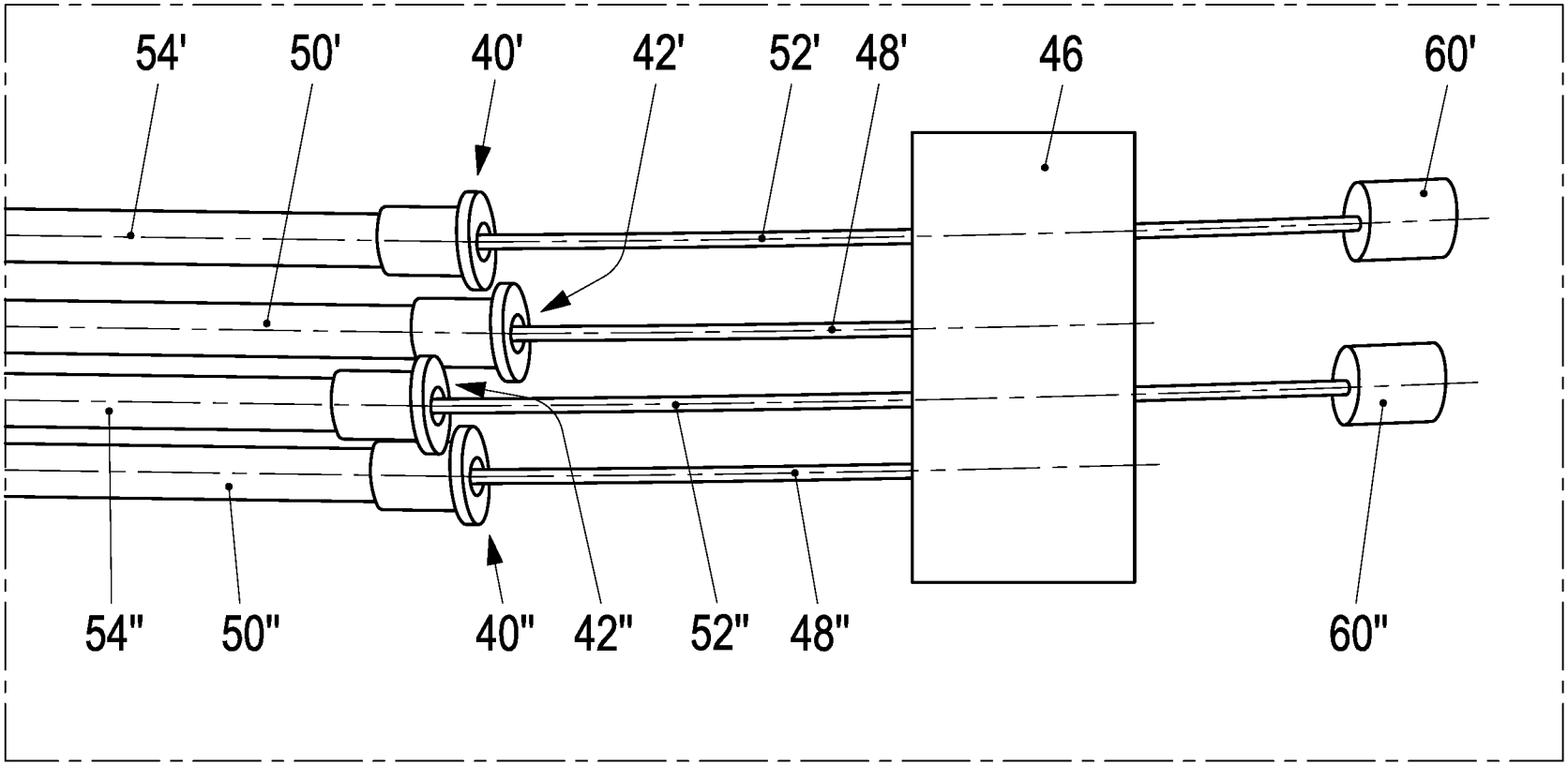
FIG. 16 shows a perspective view of a detail of an output element of the electric motor driven drive apparatus according to FIG. 15.
Figure 17:
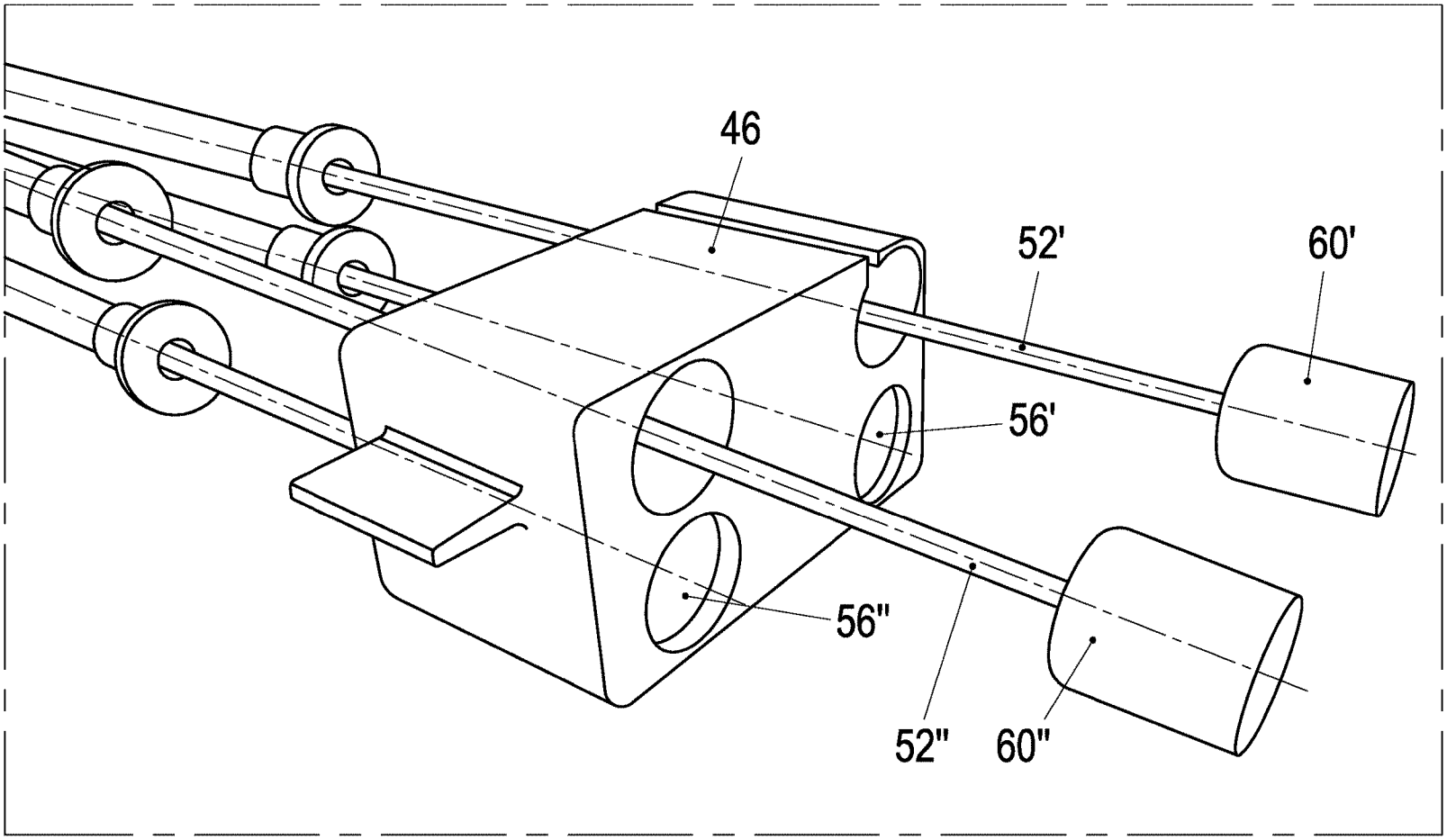
FIG. 17 shows the detail according to FIG. 16 from a different perspective.
Figure 18:
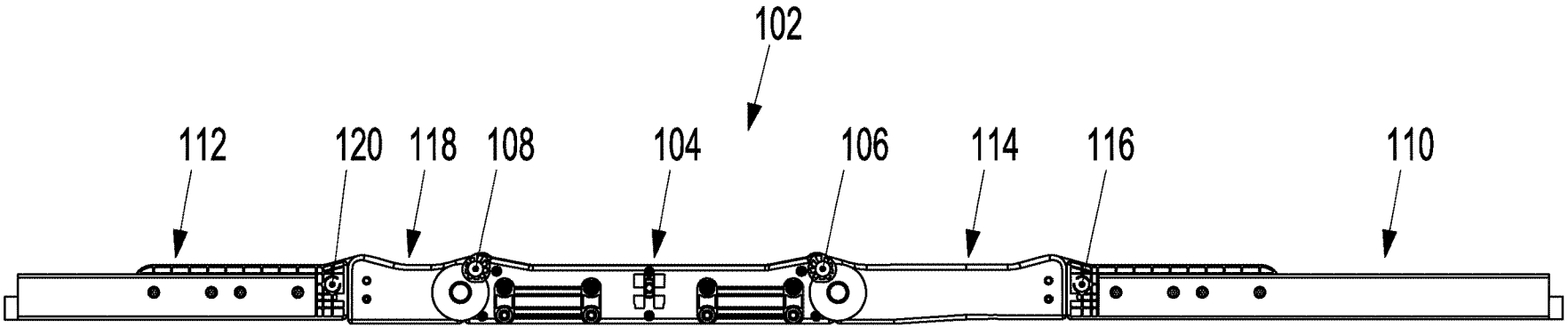
FIG. 18 shows a side view of an electric motor driven adjustable support apparatus in a second embodiment of a mattress according to the invention.

The spindle nut 46 is also discernible in FIGS. 16 and 17; for reasons of clarity, it is illustrated separately in FIGS. 16 and 17 without the threaded spindle 86.

With regard to the manner in which a support part of a support apparatus is adjusted via two Bowden cables in each case, reference is made to EP 2 792 277 B1, whose entire disclosed content is hereby incorporated by reference into the present patent application.

The Bowden cables 42', 42" (see FIG. 16) have a traction cable 48' and 48" and a jacket (Bowden cable sheathing) 50' and 50", respectively. The Bowden cables 40', 40" correspondingly have a traction cable 52', 52" and a jacket 54', 54", respectively (see FIG. 16).

The operating principle of the Bowden cables is explained in greater detail below by way of example, with reference to the Bowden cable 42'. The Bowden cable 42" has a corresponding operating principle.

The traction cable 48' is led out through an opening 54 in the housing 44 (see FIG. 15A). One end of the traction cable 48' is secured tightly to the spindle nut 46 via a barrel-shaped fastening element 56' (see FIG. 17). The other end of the traction cable 48' is secured to the neck support part 14 by means of a further barrel-shaped fastening element (see FIG. 7).

Figure 9:
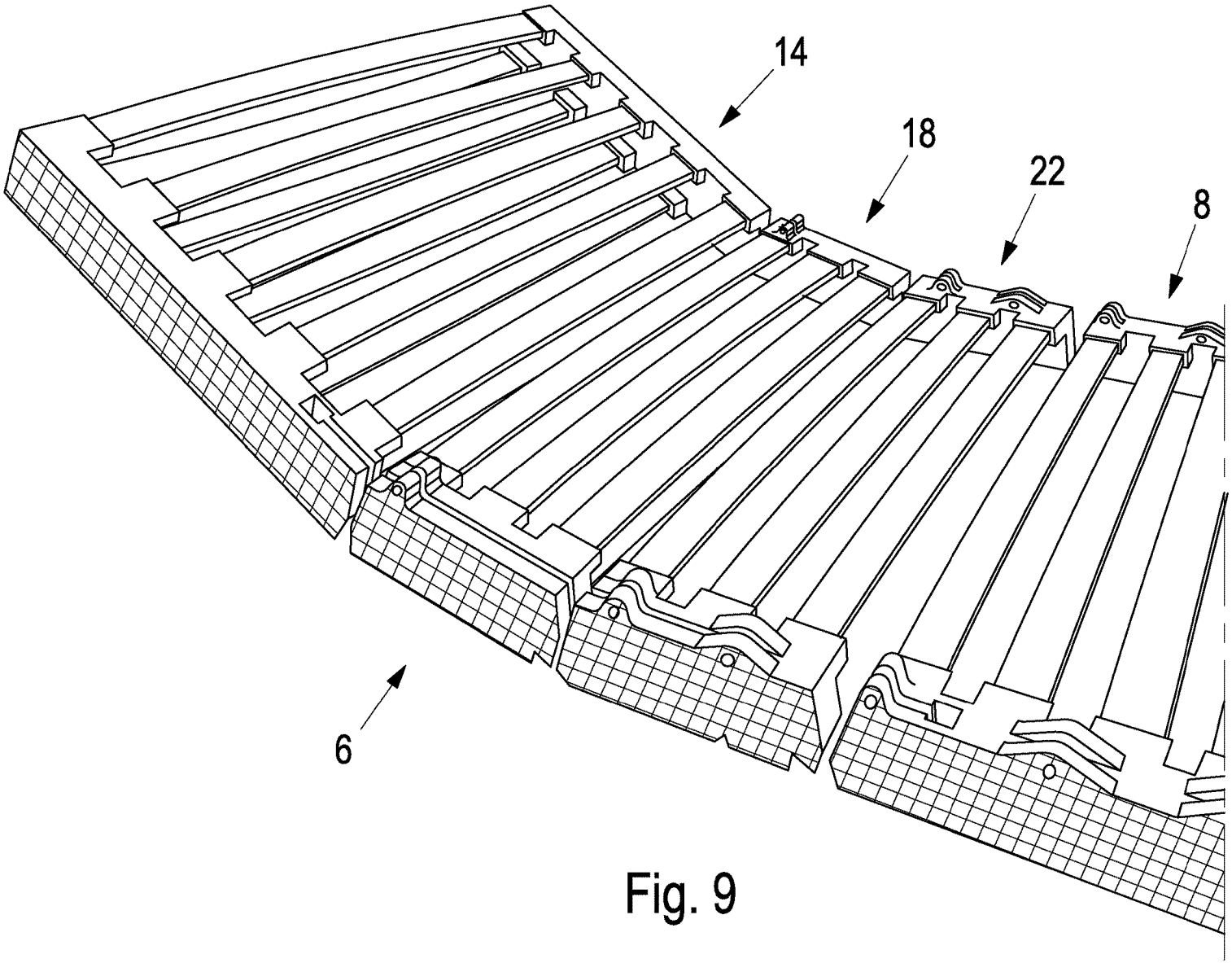
FIG. 9 shows a perspective view of a detail of the support apparatus according to FIG. 3 in the area of an upper body support part.
Figure 10:
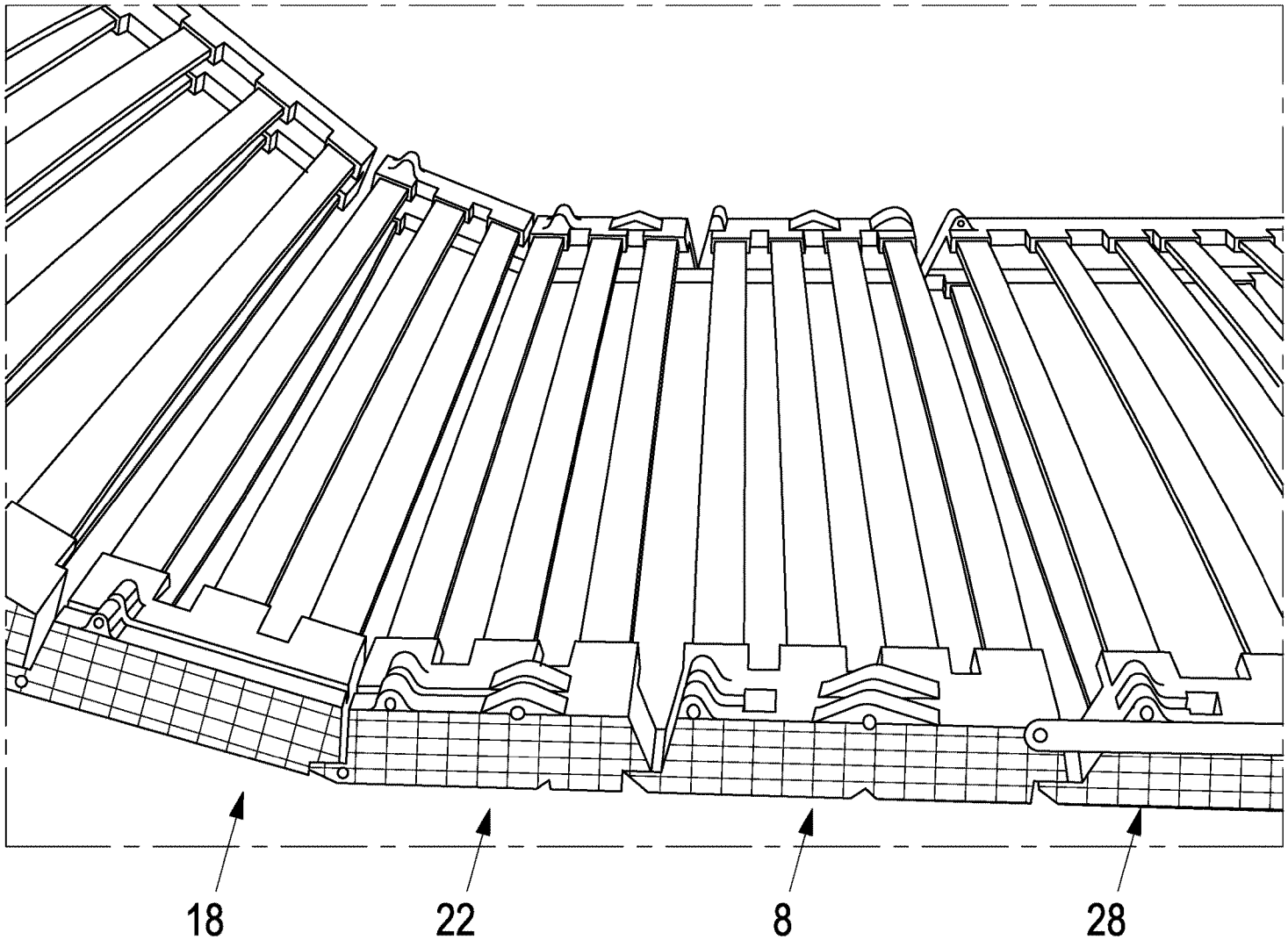
FIG. 10 shows, in the same illustration as FIG. 9, a perspective view of a detail of the support apparatus according to FIG. 3 in the area of a middle support part.
Figure 11:
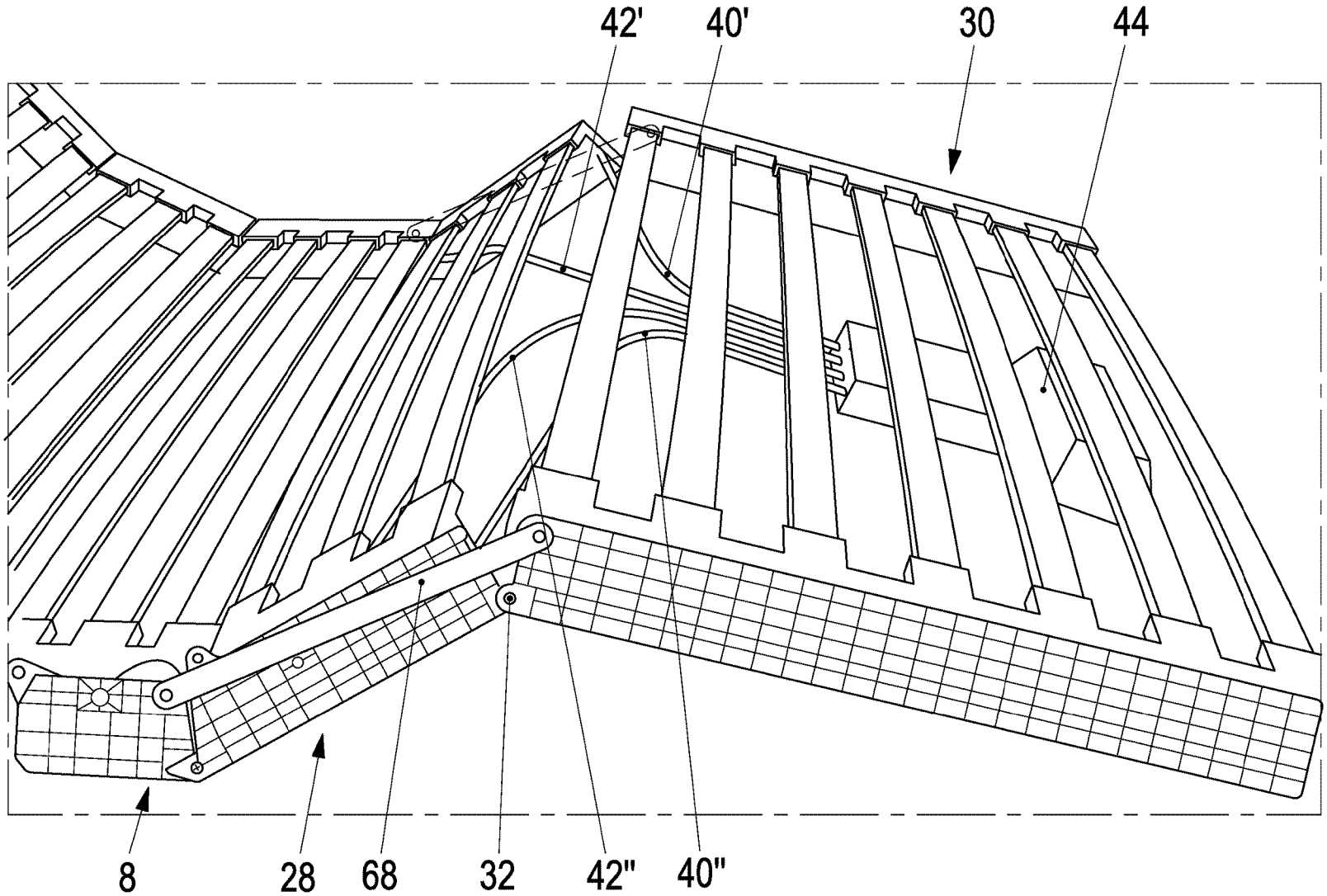
FIG. 11 shows, in the same illustration as FIG. 9, a detail of the support apparatus according to FIG. 3 in the area of a lower body support part.
Figure 12:
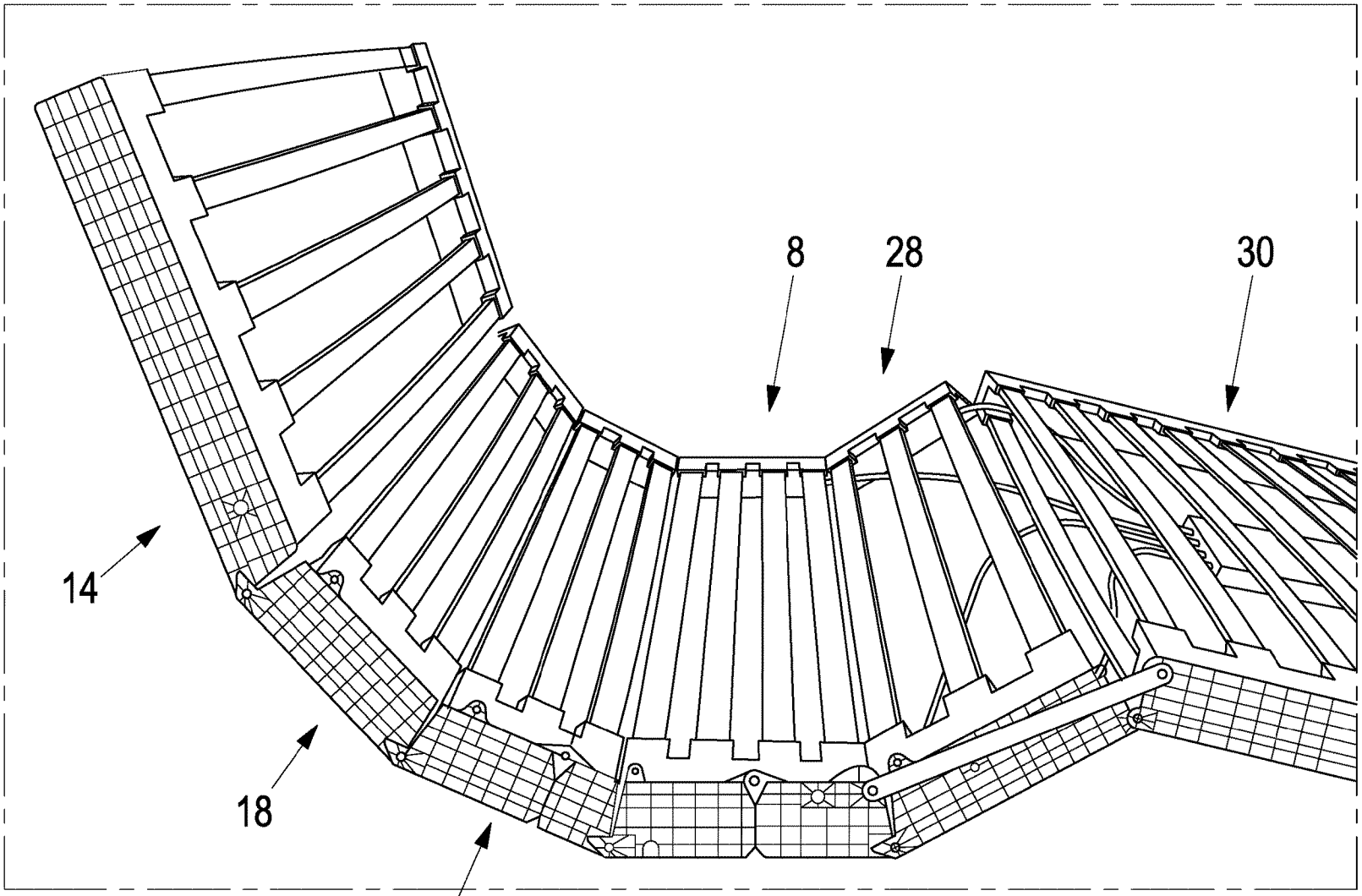
FIG. 12 shows the support apparatus according to FIG. 8 in another end position of the adjustment movement, corresponding to a sitting position.
Figure 13:
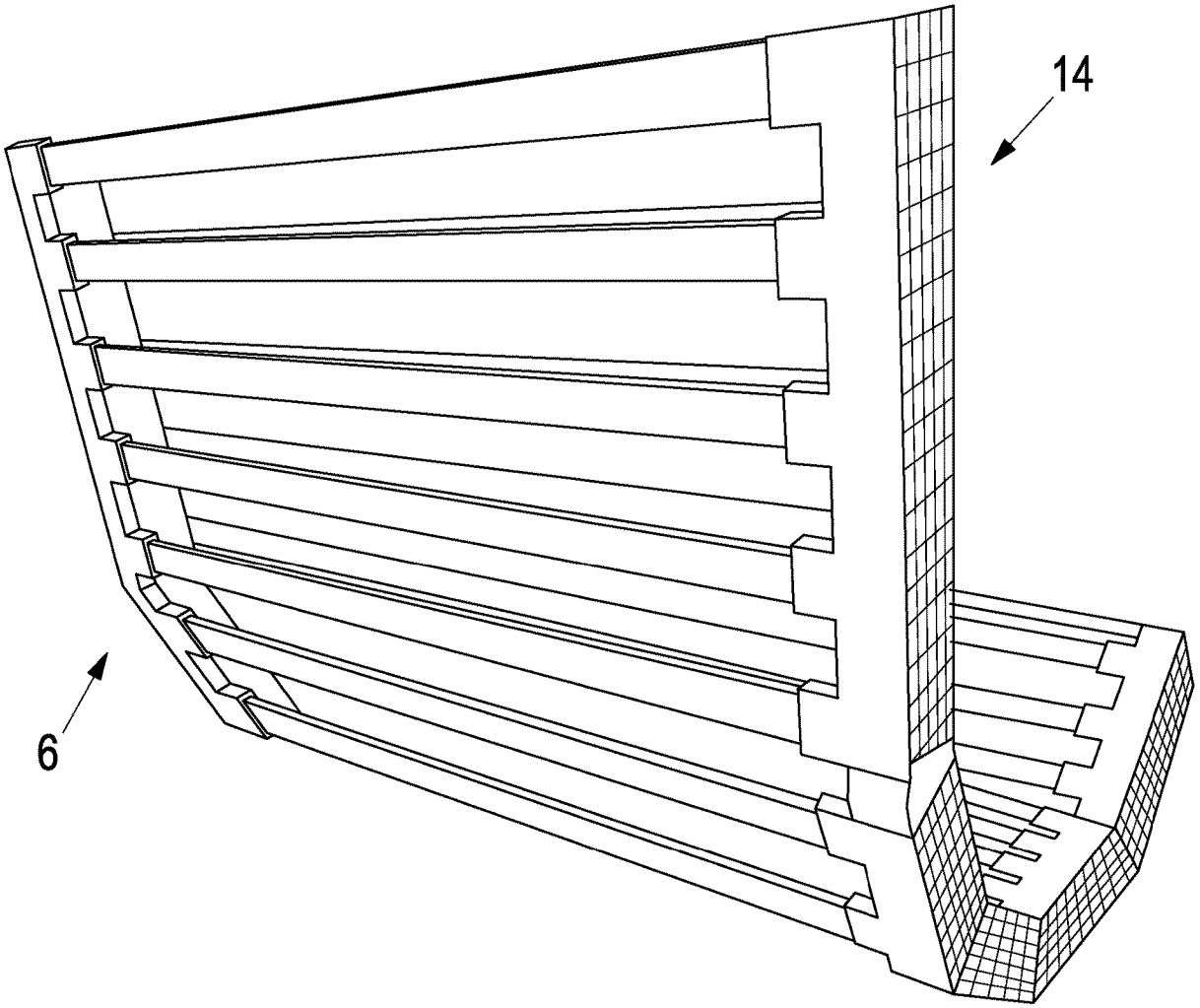
FIG. 13 shows a perspective view of a detail of the support apparatus according to FIG. 12 in the area of the upper body support part.

The jacket 50' of the Bowden cable 42' is on the one hand secured to the housing 44 (see FIG. 15) and on the other hand to the middle support part 8. FIG. 9 in particular shows how the traction cable 48' is guided from the middle support part 8, across the pelvis support part 22 and the back support part 18, to the neck support part 14.

The connection of the Bowden cable 42" to the neck support part 14 takes place in a corresponding manner, with the Bowden cables 42', 42", viewed with respect to the longitudinal center plane of the support apparatus 6, engaging on different sides of the neck support part 14 in order to uniformly introduce the adjustment force into the neck support part 14 so that twisting of the neck support part 14 during the adjustment is avoided.

For adjusting the neck support part 14 together with the back support part 18 and the pelvis support part 22 relative to the middle support part 8, the electric motor 84 drives the threaded spindle 86 in such a way that the spindle nut 46 moves to the right in FIG. 16 and FIG. 17 (to the left in FIG. 15B). The spindle nut 46 hereby pulls on the traction cables 48', 48" by means of the barrel-shaped fastening elements, so that the neck support part 14 together with the back support part 18 and the pelvis support part 22 are initially pivoted relative to the middle support part 8 until the end position of the adjustment movement illustrated in FIG. 6 and FIG. 1 is reached.

The Bowden cables 40', 40" are used in a corresponding manner for adjusting the thigh support part 28, and thus the lower body support part 26, relative to the middle support part 8. For this purpose, the jackets 54', 54" are secured on the one hand to the housing 44 (see FIG. 15) and on the other hand to the middle support part 8. The traction cable 52' has a barrel-shaped fastening element 60 on one end, and has a barrel-shaped fastening element 62 on its other end (see FIG. 8) which is secured to the thigh support part 28. The jacket 54 of the Bowden cable 40' is secured on the one hand to the housing 44 (see FIG. 15) and on the other hand to the middle support part 8. The connection of the Bowden cable 40" to the thigh support part 28 takes place in a corresponding manner.

Resetting the support parts of the support apparatus into the starting position of the adjustment movement takes place under the weight force of their own weight plus that of the person resting thereon, but with the drive apparatus switched on.

In the illustrated embodiment, the shared single electric motor 84 is operatively connected to the upper body support part 12 and to the lower body support part 26 in such a way that the adjustment of the upper body support part 12 and of the lower body support part 26 takes place in a time-delayed manner, at least in phases, during the adjustment movement. In the illustrated embodiment, the time delay is designed in such a way that the adjustment of the lower body support part 26 begins later than the adjustment of the upper body support part 12. For this purpose, on the one hand the Bowden cables 42', 42" associated with the upper body support part 12 and on the other hand the Bowden cables 40', 40" associated with the lower body support part 26 are designed and configured in such a way that during the adjustment, the output element initially pulls on the Bowden cables 42', 42" associated with the upper body support part 12, and pulls on the Bowden cables 40', 40" associated with the lower body support part 26 only in the further course of the adjustment movement, so that the adjustment of the lower body support part 26 begins later than the adjustment of the upper body support part.

When the spindle nut 46 moves to the right in FIG. 16 or FIG. 17, initially the neck support part 14 together with the back support part 18 and the pelvis support part 22 are adjusted relative to the middle support part 8 in the above-described manner.

As the spindle nut 46 continues to move, it subsequently comes into engagement with the barrel-shaped fastening elements 60', 60", so that the thigh support part 28 together with the calf support part 30 is then adjusted relative to the middle support part 8. In this way, initially the upper body support part 12 is moved, and only then is the lower body support part 26 moved in the adjustment.

As a result, according to the invention the adjustment of the upper body support part 12 and of the lower body support part 26 takes place in a time-delayed manner, at least in phases, during the adjustment movement.

In the illustrated embodiment, the spindle nut 46 (output element) thus initially carries out an idle stroke with respect to the traction cables 52', 52" before the spindle nut 46 begins to pull on the traction cables 52', 52", thus adjusting the lower body support part 26. Due to the length of the idle stroke, it may be specified by design whether and to what extent a time delay occurs during the adjustment of the upper body support part 12 and of the lower body support part 26.

However, it is also possible according to the invention to carry out the adjustment of the upper body support part 12 and of the lower body support part 26 simultaneously.

It is also possible according to the invention to design only the upper body support part 12 to be adjustable, while the lower body support part 26 always remains unadjusted in its position illustrated in FIG. 4 and FIG. 5. Furthermore, it is possible to provide at least two independently controllable electric motors for independently adjusting the upper body support part 12 and the lower body support part 26. It is also possible to provide more than two electric motors, depending on the particular requirements.

For supporting the cushion element, the support parts of the support apparatus 6 on their sides facing the cushion element (see FIG. 1) are provided with elastically resilient spring elements, of which a spring element, denoted by numeral 64, is provided in FIG. 3 strictly by way of example.

According to the invention, at least one support part also has, in addition to the spring elements 64 situated on the side facing the cushion element, further spring elements situated on the side facing away from the cushion element, i.e., the bottom side in FIG. 3, so that the support apparatus 6 is provided, at least in sections, with spring elements on both sides along its longitudinal extension. Of the further spring elements, a spring element denoted by reference numeral 66 is provided in FIG. 3 strictly by way of example.

In the illustrated embodiment, the spring elements 64 have a slat-like design and are made of plastic.

As is apparent from FIG. 3, in the illustrated embodiment all support parts of the support apparatus 6 are provided with spring elements 64, 66 on both sides. However, it is also possible according to the invention for only individual support parts to be provided with spring elements 64, 66 on both sides, while other support parts are provided with spring elements 64 only on their sides facing the cushion element. Due to the spring elements situated on both sides of the support apparatus 6, on the one hand the suspension comfort is increased. On the other hand, the mattress 2 may be placed on the floor without an additional base, with sufficient ventilation of the cushion element being ensured.

Figure 14:
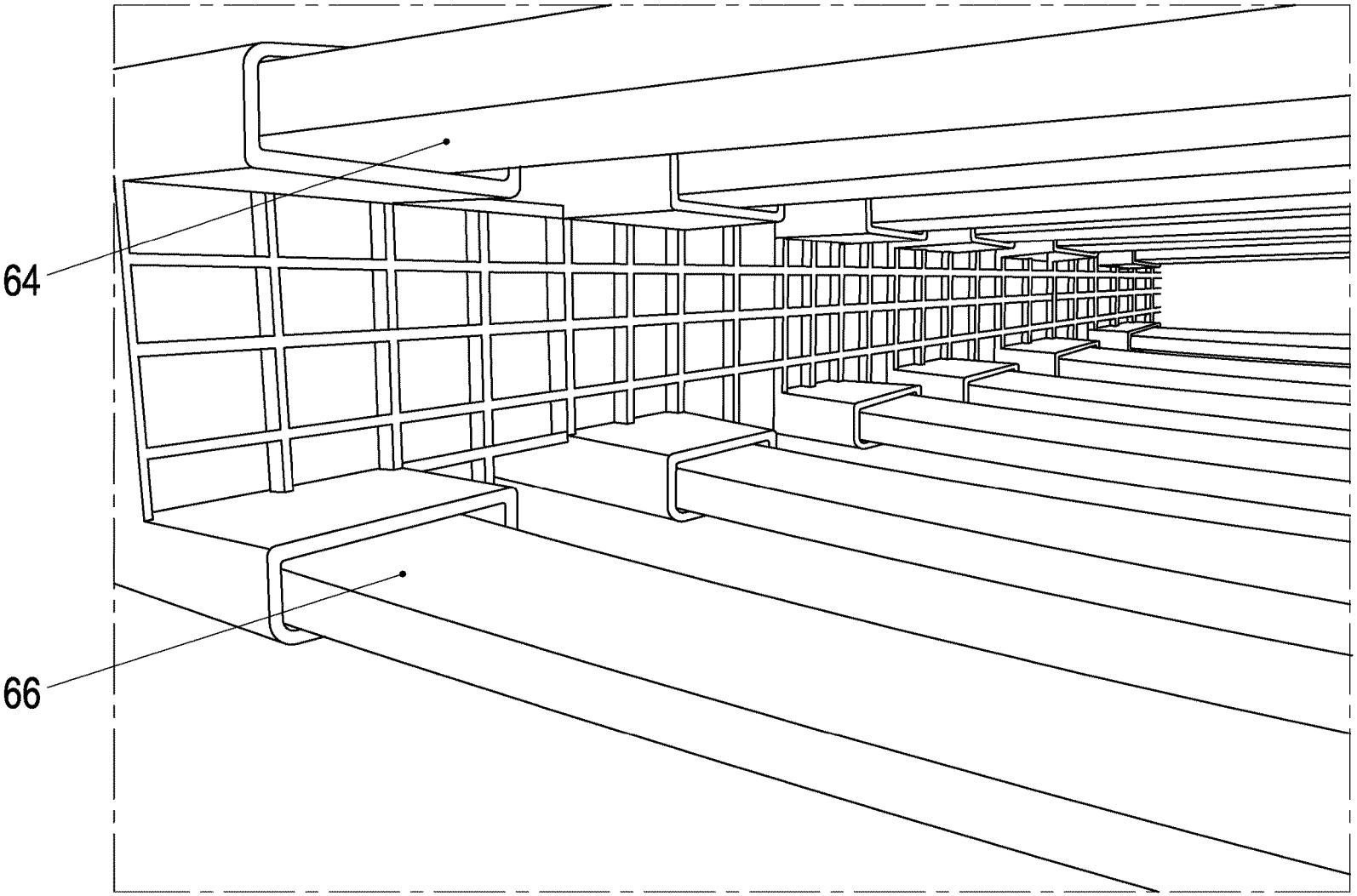
FIG. 14 shows a perspective view and a detail from FIG. 8, in enlarged scale compared to FIG. 8.

It is also apparent in particular from FIG. 14 that the support parts of the support apparatus 6 are provided with spring elements 64, 66 on both sides.

The adjustment of the pelvis support part 22 together with the back support part 18 and the neck support part 14 on the one hand and the adjustment of the thigh support part 28 relative to the middle support part 8 [on the other hand] take place in the above-described manner under the drive action of the electric motor driven drive apparatus 38. When the thigh support part 28 pivots relative to the middle support part 8, the calf support part 30 pivots relative to the thigh support part 28 about the pivot axis 32 due to the force of gravity, without drive power, as is apparent from FIG. 11, for example.

To prevent the calf support part 30 from loosely moving relative to the thigh support part 28 about the pivot axis 32 in an adjusted position, a means for fixing the calf support part 30 relative to the thigh support part 28 in the adjusted position is provided. In the illustrated embodiment, this means has a metal bracket 68 in the form of a flat bar (see FIG. 7 and FIG. 11), whose ends are articulatedly connected at hinge points 29, 31, on the one hand to the middle support part 8, remote from the pivot axis 24, and on the other hand to the calf support part 30, remote from the pivot axis 32. A bracket corresponding to the bracket 68 is also situated on the other longitudinal side of the support apparatus 6. The functioning of the bracket 68 is explained in greater detail below with reference to FIG. 27.

In the illustrated embodiment, a further cushion element 70 is situated on the side of the support apparatus facing away from the cushion element (see FIG. 1), so that the support apparatus is situated between the cushion elements in the manner of a sandwich. The surface of the cushion elements corresponds to the surface of the support apparatus 2.

A second embodiment of a mattress 100 according to the invention is explained in greater detail below with reference to FIGS. 18 through 26.

In the illustrated embodiment, the support apparatus 102 has a middle first support part 104, the ends of which are connected, about mutually parallel pivot axes 106, 108, on the one hand to a second support part 110 that forms an upper body support part, and on the other hand to a third support part 112 that forms a lower body support part.

The connection between the second support part 110 and the first support part 104 on the one hand, and between the third support part 112 and the first support part 104 on the other hand, is formed by means of bending and folding axes in such a way that for folding the mattress 100, the third support part 112 is foldable onto the first support part 104, and the second support part 110 is subsequently foldable onto the side of the third support part 112 facing away from the middle support part 104.

In the illustrated embodiment, the connection between the first support part 104 and the second support part 110 is formed via a first intermediate support part 114 that is connected to the first support part 104 so as to be pivotable about the pivot axis 106. The second support part 110 is connected to the first intermediate support part 114 via a pivot axis 116 that is parallel to the pivot axis 106.

In the folded-up or collapsed state of the mattress 100 (see FIG. 24F), the second support part 110 is situated essentially parallel to the first support part 104, wherein the length of the first intermediate support part 114 is selected so that in the folded-up state, taking into account the thickness of the cushion structure (cushion element) of the mattress 100, the distance between a facing surface of the second support part 110 and the first support part 104 essentially corresponds to the thickness of the third support part 112 plus the cushion structure, and the surfaces of the third support part 112 rest against the respective facing surface of the second support part 110 and of the first support part 104.

Correspondingly, the connection between the third support part 112 and the first support part 104 is formed via a second intermediate support part 118, which on the one hand is connected to the first support part 104 so as to be pivotable about the pivot axis 108. The other end of the second intermediate support part 118 is connected to the third support part 112 about a pivot axis 120 that is parallel to the pivot axis 108, wherein the length of the second intermediate support part 118 is dimensioned so that when the third support part 112, including the cushion structure, is folded onto the first support part 104, the third support part 112 and the first support part 104 are situated essentially parallel to one another (see FIG. 21 and FIG. 25).

Whereas in the first embodiment, bending and folding axes are provided in addition to the pivot axes, in the second embodiment the pivot axes 116, 120 at the same time have the function of a bending and folding axis.

For adjusting the second support part 110 relative to the first support part 104, an electric motor driven adjustment apparatus is provided which has an electric motor driven drive apparatus that is operatively connected to the support parts via an adjustment mechanism. The design of such electric motor driven adjustment apparatuses is generally known to those skilled in the art, and is therefore not explained here in greater detail. The electric motor driven adjustment apparatus may be designed, for example and in particular, as described with respect to the first embodiment.

Figure 21:
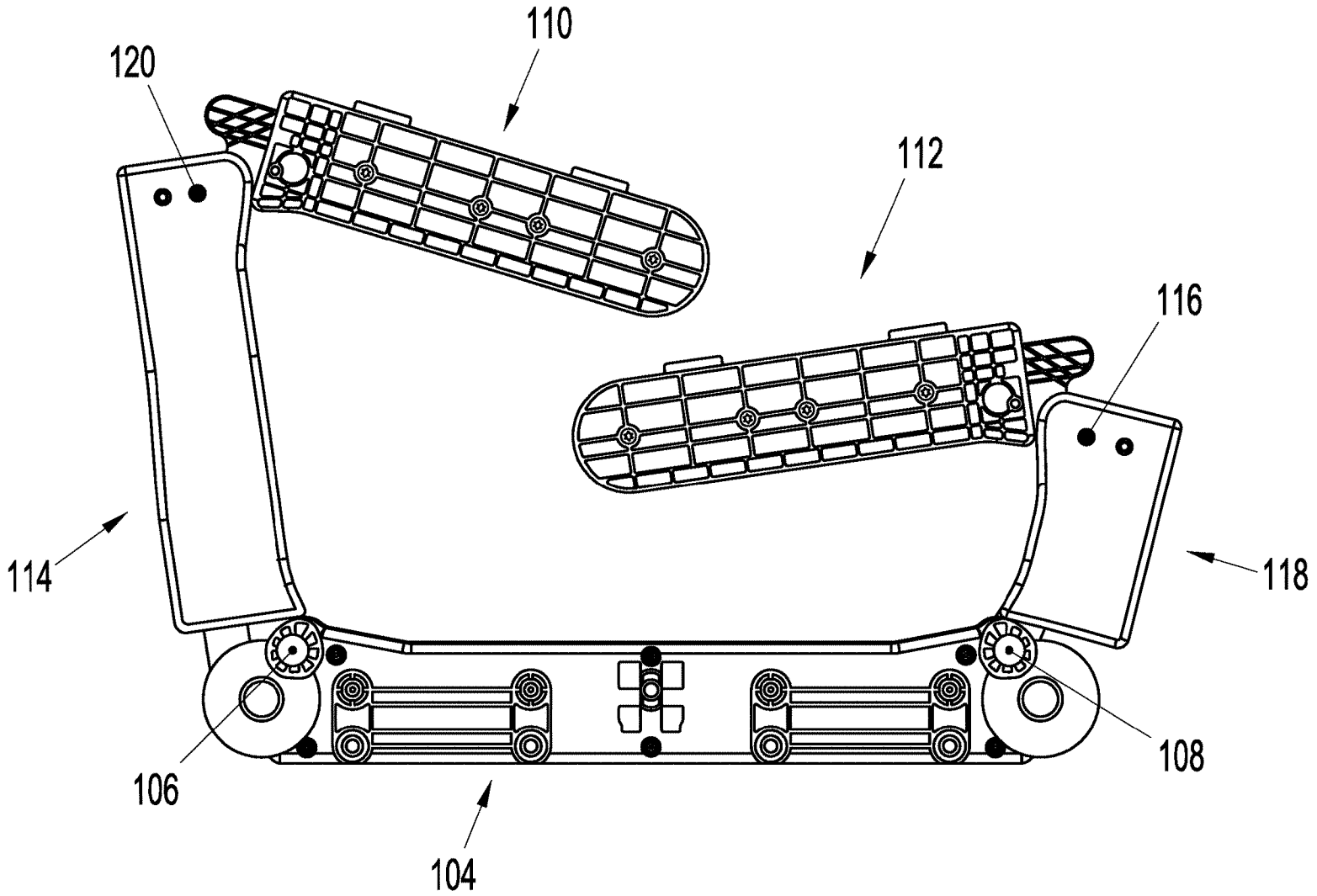
FIG. 21 shows the support apparatus according to FIG. 18 in the folded-up state.
Figure 25:
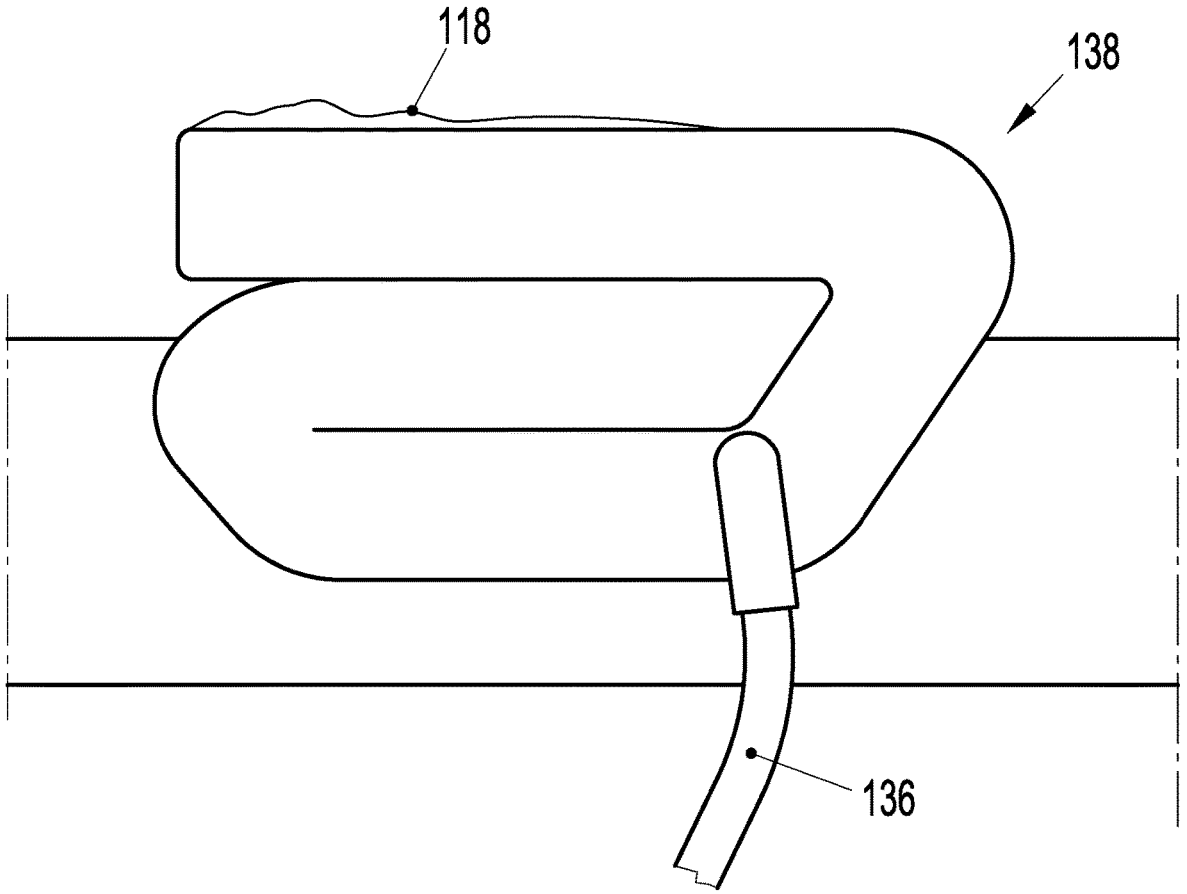
FIG. 25 shows a storage and transport unit formed using the method according to FIGS. 24A through 24E.

The electric motor driven adjustment apparatus is designed in such a way that the second support part 110 together with the cushion structure may be folded onto the first support part 104 (see FIG. 21 and FIG. 25). For this purpose, an adjustment element of the electric motor driven adjustment apparatus loosely acts on the second support part 110 or the first intermediate support part connected thereto to allow folding of the second support part 110 onto the first support part 104 beyond the maximally adjusted end position of the adjustment movement defined by the electric motor driven adjustment apparatus.

In the illustrated embodiment, the third support part 112 is foldably connected to the first support part 104 via the second intermediate support part 118 (see FIG. 21 and FIG. 25), but is not adjustable via the electric motor. If desired, however, depending on the particular requirements, the third support part 112 may also be adjustable relative to the first support part 104 via the electric motor.

Figure 19:
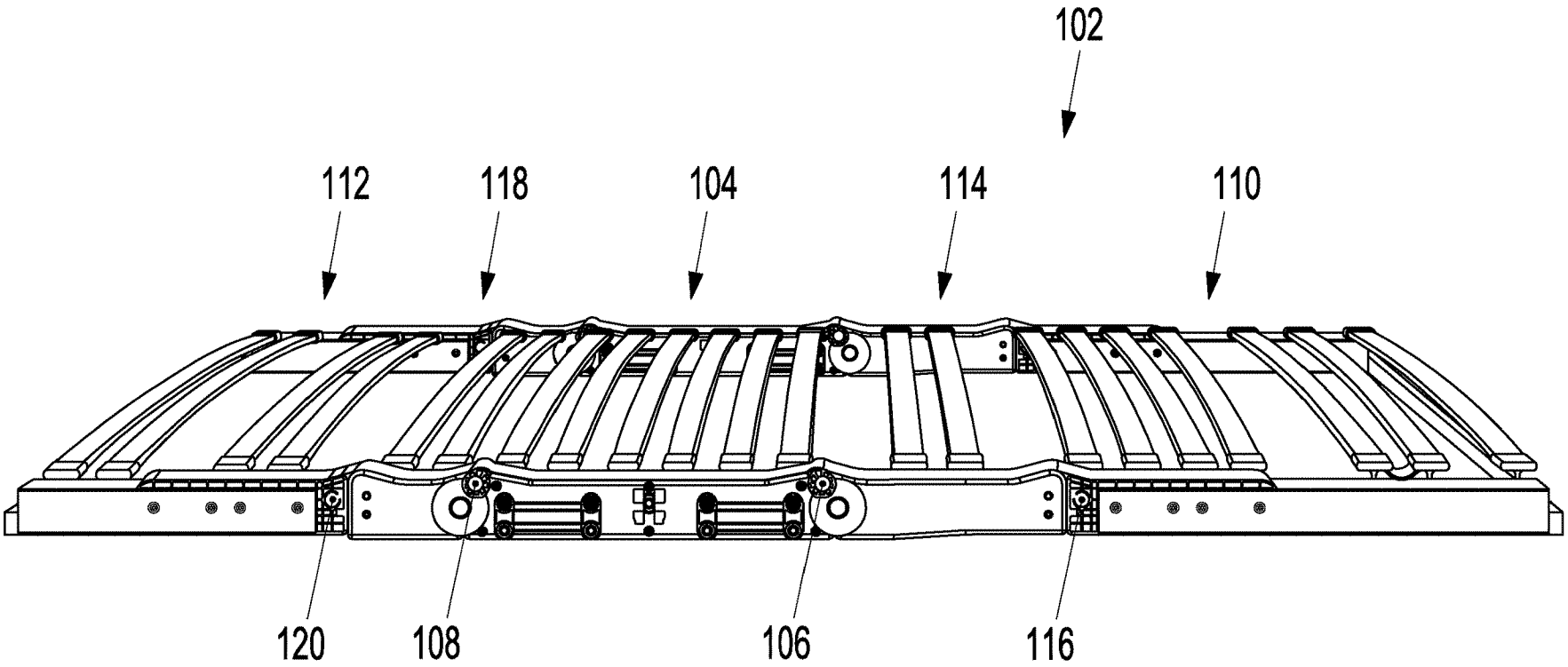
FIG. 19 shows the support apparatus according to FIG. 18 in a perspective view, with the support parts of the support apparatus illustrated in an unadjusted starting position.

FIG. 19 shows the support parts 110, 112, 114 in an unadjusted starting position in which the second support part 110 in addition to the intermediate support part 114, together with the first support part 104 and the third support part 112 in addition to the second intermediate support part 118, span an essentially horizontal support plane.

Figure 20:
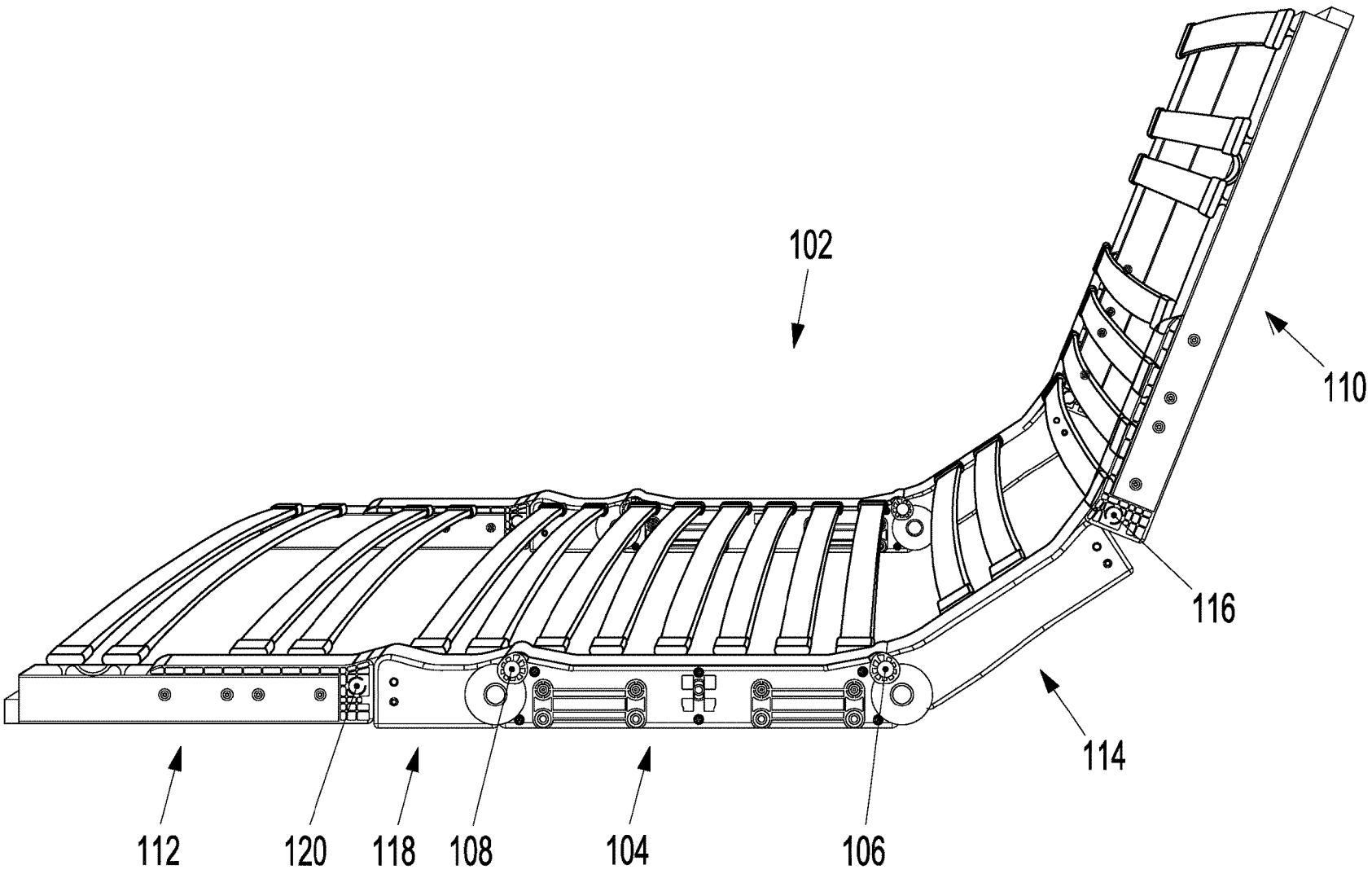
FIG. 20 shows the support apparatus according to FIG. 18 in an illustration similar to FIG. 19, with the support parts of the support apparatus illustrated in an adjustment position with maximum adjustment relative to one another.

FIG. 20 shows the support apparatus 102 in a maximally adjusted end position of the adjustment movement, in which the second support part 110 in addition to the first intermediate support part 114 is maximally pivotably adjusted relative to the first support part 104.

FIG. 21 schematically illustrates the folding up of the support parts 102, 112 onto one another and onto the first support part 104 in order to fold the mattress 100; components of the support apparatus 102 are omitted for purposes of illustration.

Figure 22:
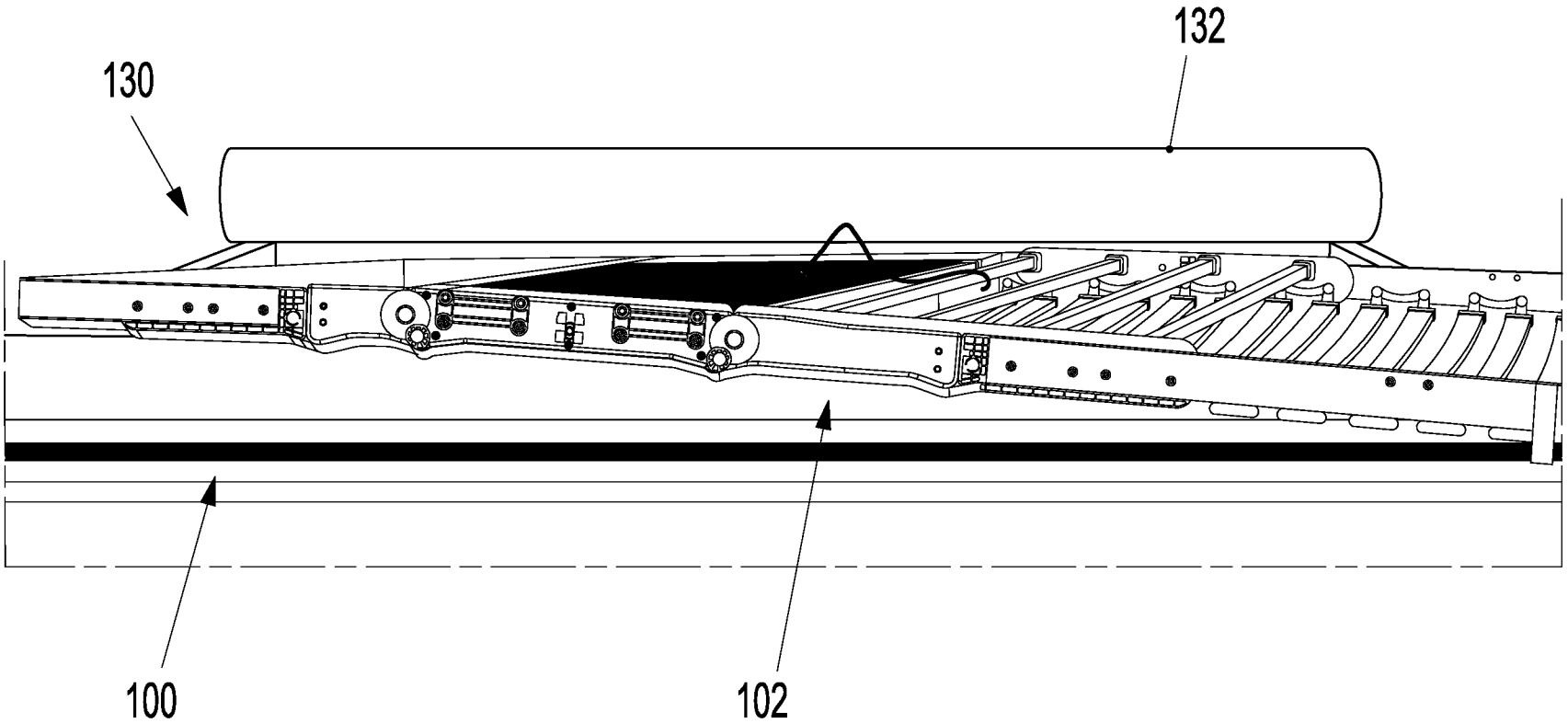
FIG. 22 shows the support apparatus according to FIG. 18 during introduction into a cushion structure of a mattress, in a perspective view.
Figure 23:
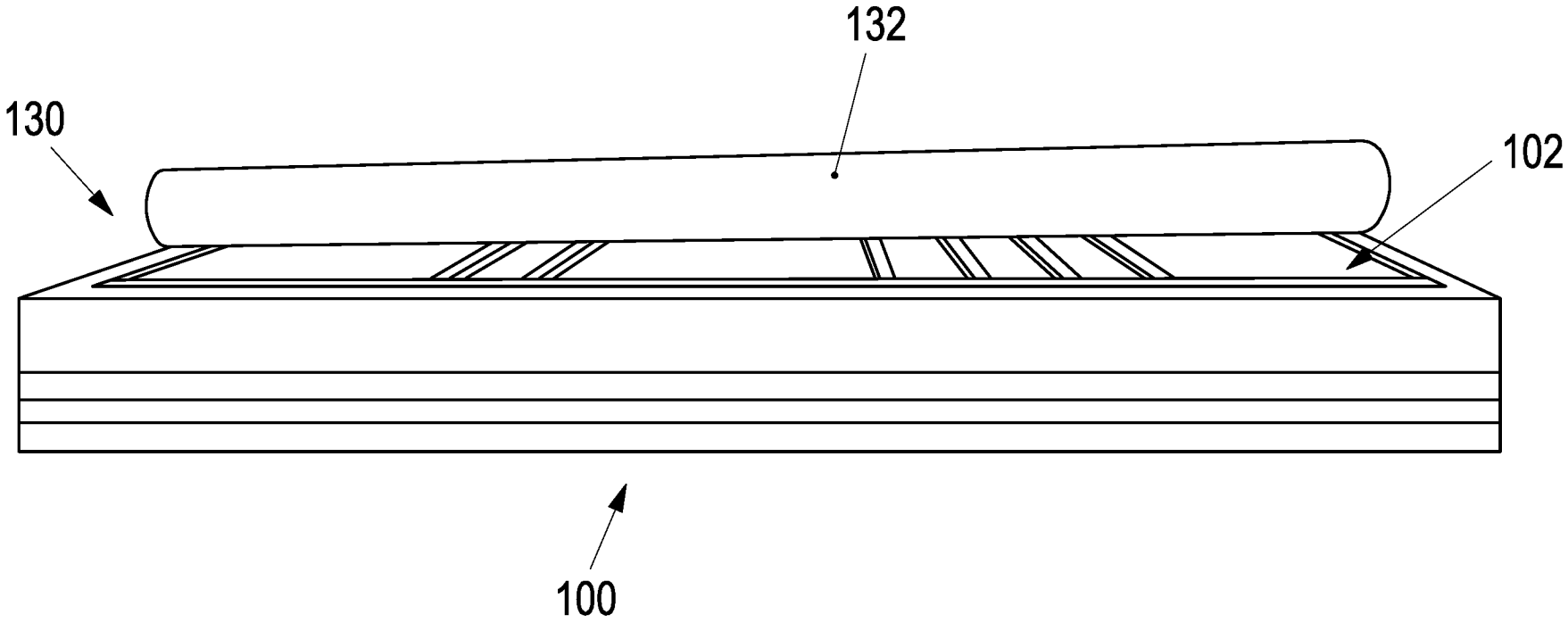
FIG. 23 shows, in the same illustration as FIG. 22, the support apparatus introduced into the cushion structure.

FIGS. 22 and 23 illustrate the introduction of the support apparatus 102 into the mattress 100. In the illustrated embodiment, the mattress 100 has a cushion structure 130, which in the illustrated embodiment has at least two horizontal cushion elements situated one on top of the other, of which only a top cushion element, denoted by reference numeral 132, is discernible in FIGS. 22 and 23.

The cushion structure also has a lower cushion element on which the support apparatus 102 is placed, as illustrated in FIG. 23. After the support apparatus 102 is placed on the lower cushion element, the upper cushion element 132 may be placed on the support apparatus 102, so that the support apparatus 102 is accommodated between the lower cushion element and the upper cushion element 132 in the manner of a sandwich. The cushion structure 130 together with the inserted support apparatus 102 may subsequently be introduced into a casing of the mattress 100, as illustrated in FIG. 24A.

One embodiment of a method for preparing the mattress 100 for transport or storage is explained below with reference to FIGS. 24A through 24F.

Figure 24A:
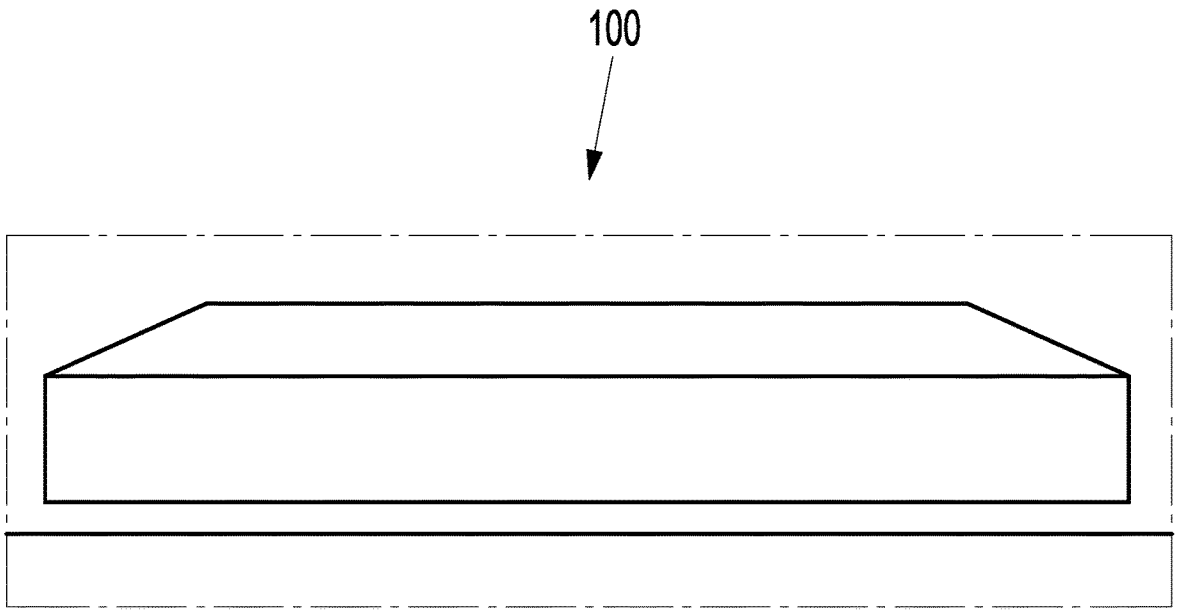
FIGS. 24A-24F show successive method steps in carrying out one embodiment of a method according to the invention.

FIG. 24A shows the mattress 100 in its starting state. To form a compact transport and storage unit, the mattress 100 is introduced into an essentially gas-tight wrapping 134, which in the present embodiment is formed by a transparent plastic film.

Figure 24B:
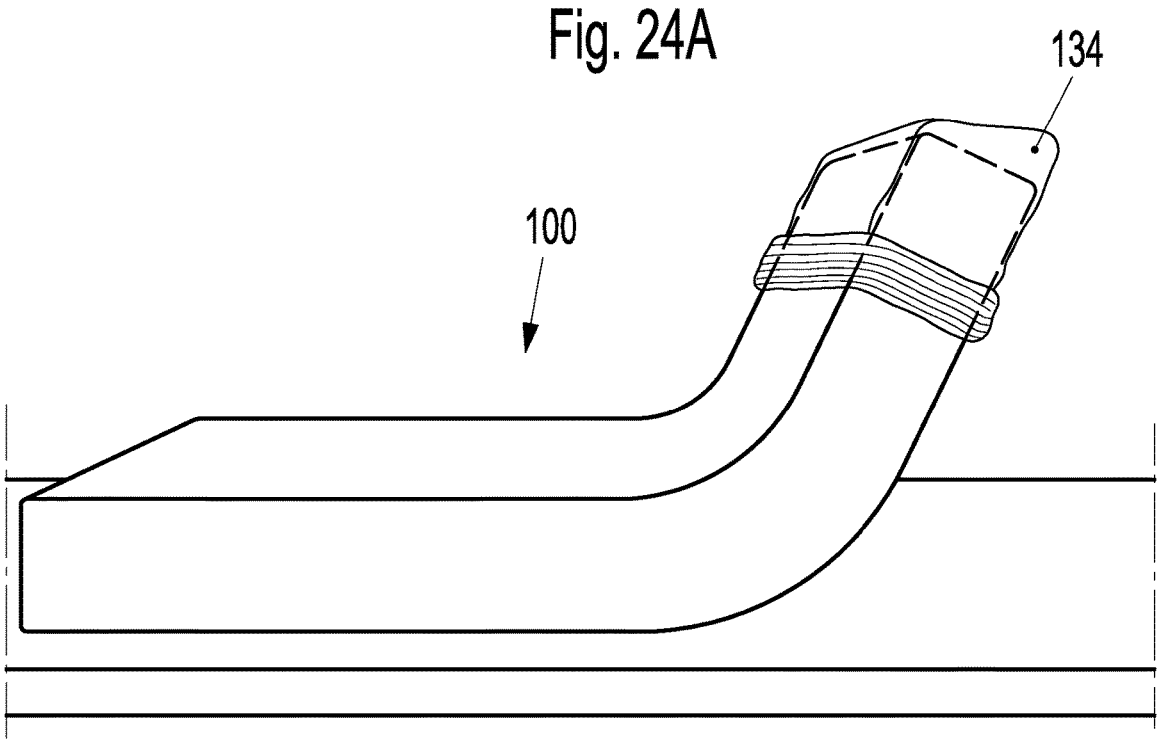
Figure 24C:
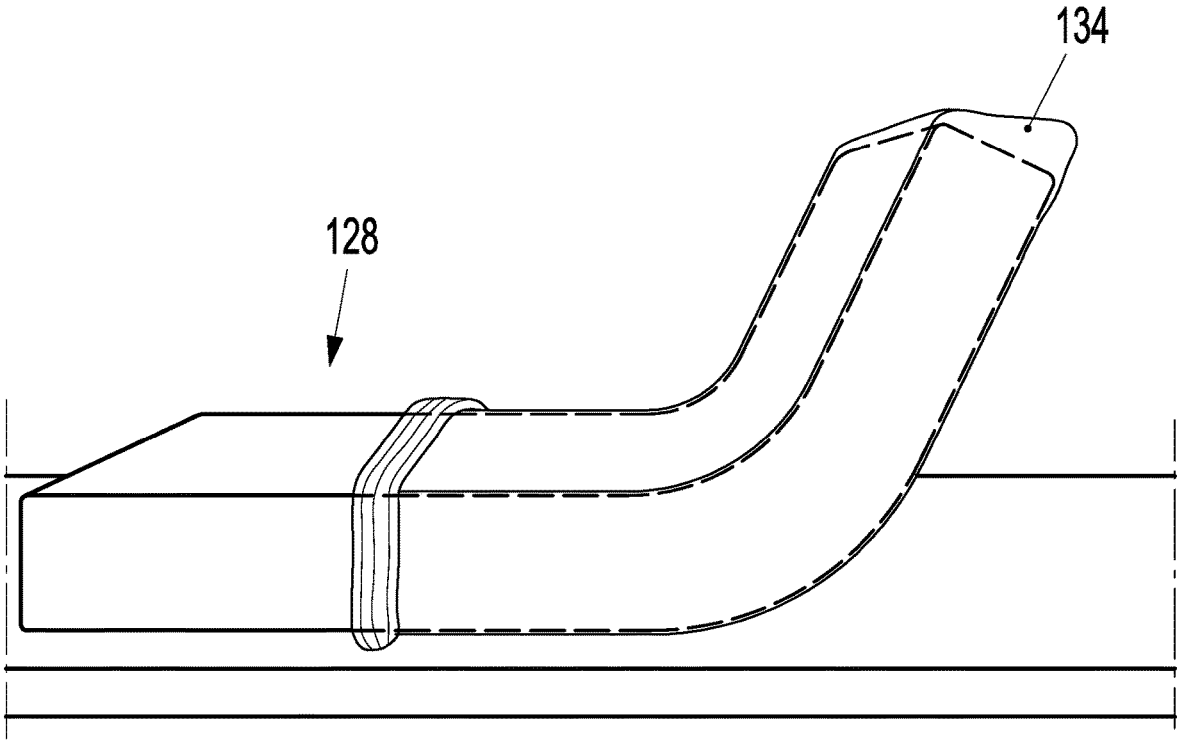

FIGS. 24B and 24C illustrate how the wrapping is initially pulled over the mattress 100.

Figure 24D:
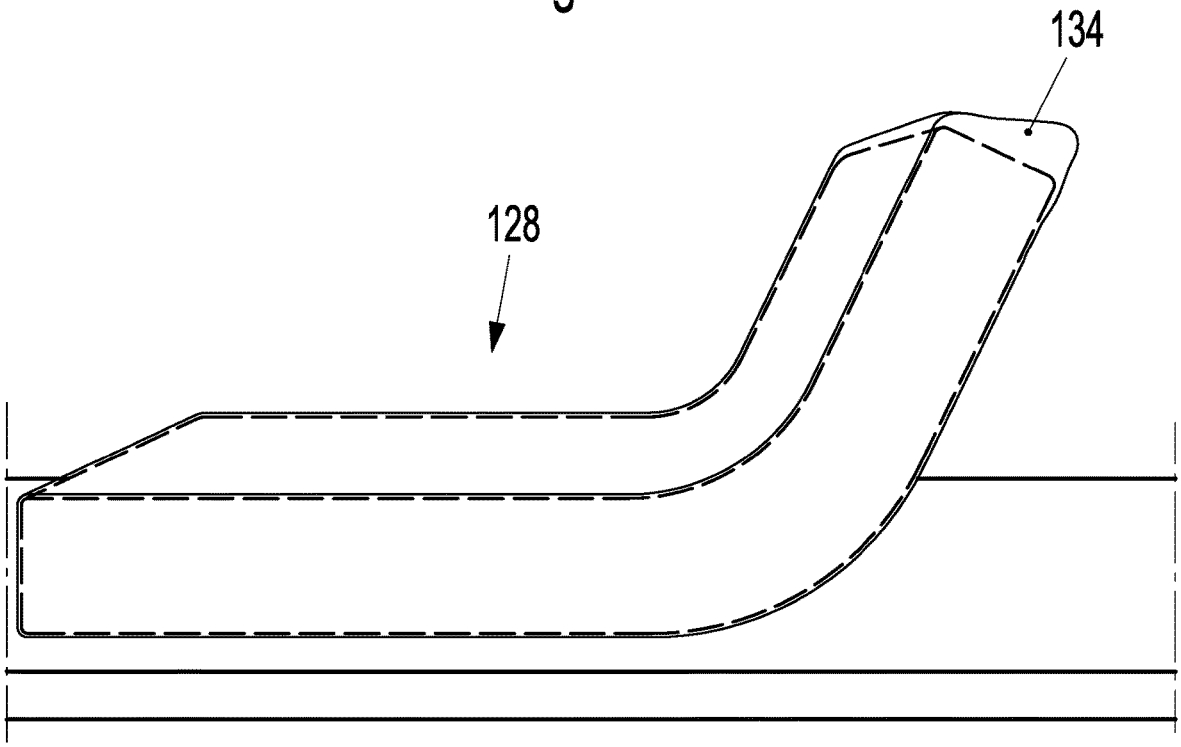
Figure 24E:
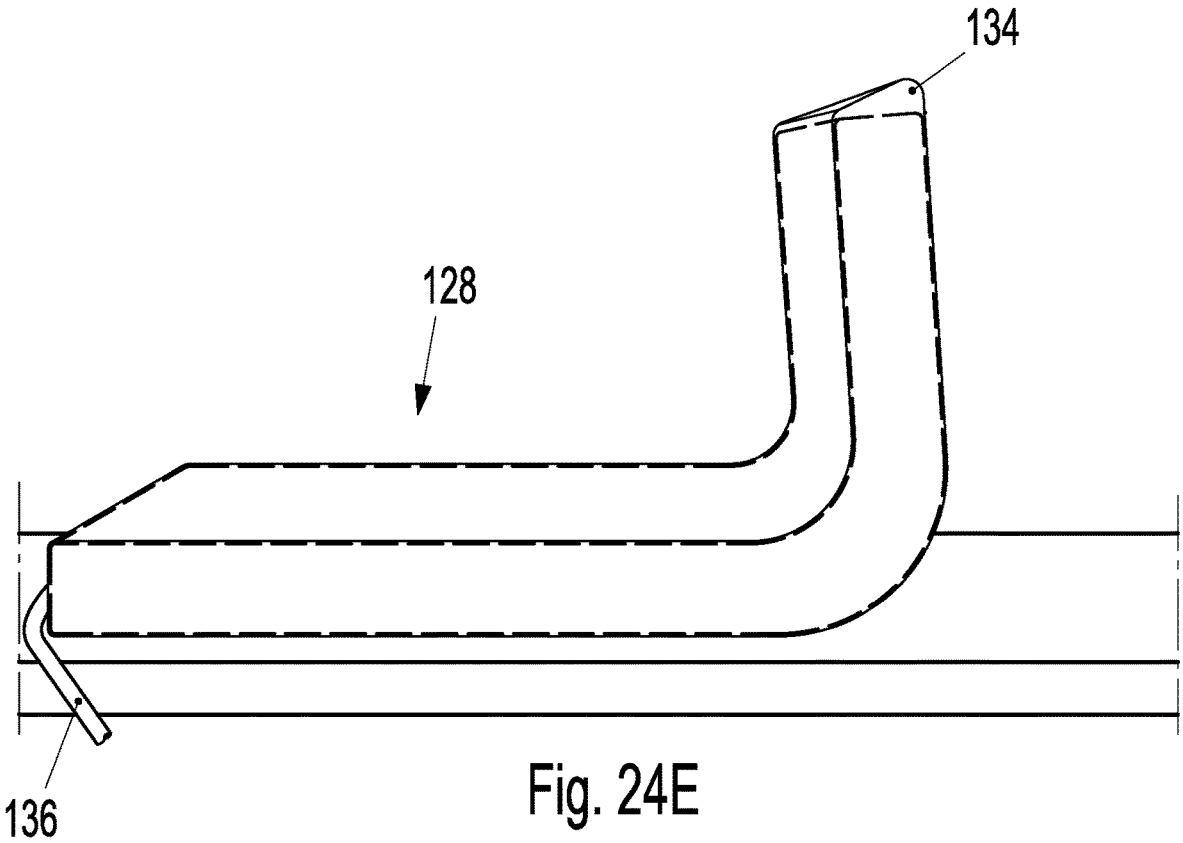

FIG. 24D shows the mattress 100 in a state in which the mattress 100 is completely accommodated in the wrapping 134.

As is apparent from FIGS. 24B-24D, the second support part 110 has been moved beforehand, relative to the first support part 104, into the maximally adjusted end position of the adjustment movement by means of the electric motor driven adjustment apparatus.

A vacuum device is subsequently connected to the wrapping 134 via a tube 136, and a vacuum is created in the wrapping 134, as the result of which the cushion structure 30 of the mattress 100 begins to be compressed.

Figure 24F:
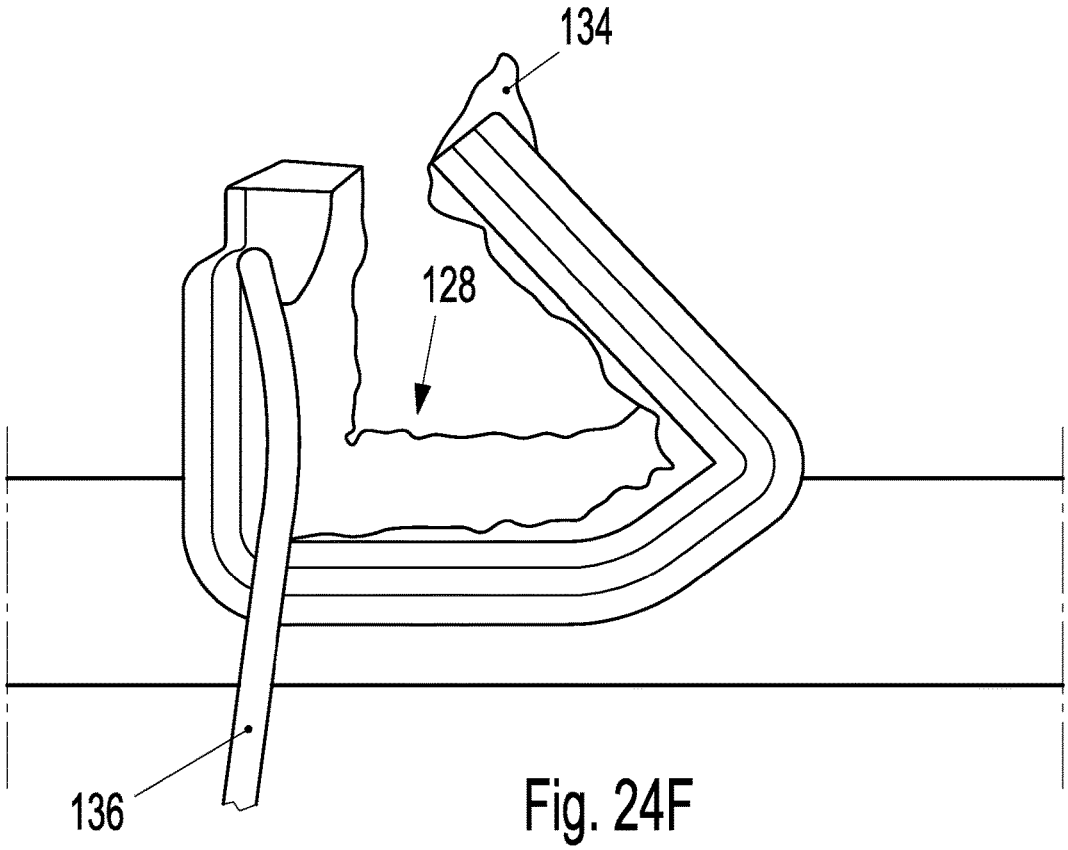

FIG. 24F shows the mattress 100 in a state in which the cushion structure 134 is maximally compressed. In this state, the third support part 112 is folded onto the first support part 104, and the second support part 110 is subsequently folded onto the third support part 112, as indicated in FIG. 24F.

FIG. 25 shows the storage and transport unit 136 that is formed at the conclusion of the method. It is apparent that the third support part 112 is folded onto the first support part 4, and the second support part 110 is folded onto the third support part 112, so that the second support part 110 and the first support part 104 are situated essentially parallel to one another, and the surfaces of the third support part 112 rest against the respective facing surface of the first support part 104 and the second support part 110. In this state, an opening in the wrapping 134 to which the tube 136 has been connected may be sealed gas-tight, for example by welding the plastic film.

It is apparent that a compact storage and transport unit has thus been formed, in which in particular the longest extension defined by the longitudinal extension of the mattress 100 is significantly reduced.

Due to its compactness, the storage and transport unit may be easily shipped via a parcel service. For self-pickup by a user, due to the compactness of the storage and transport unit 138, transport is likewise simplified and is easily possible in a passenger vehicle.

To simplify the transport even further, the storage and transport unit 138 may be provided with a rolling means.

Figure 26:
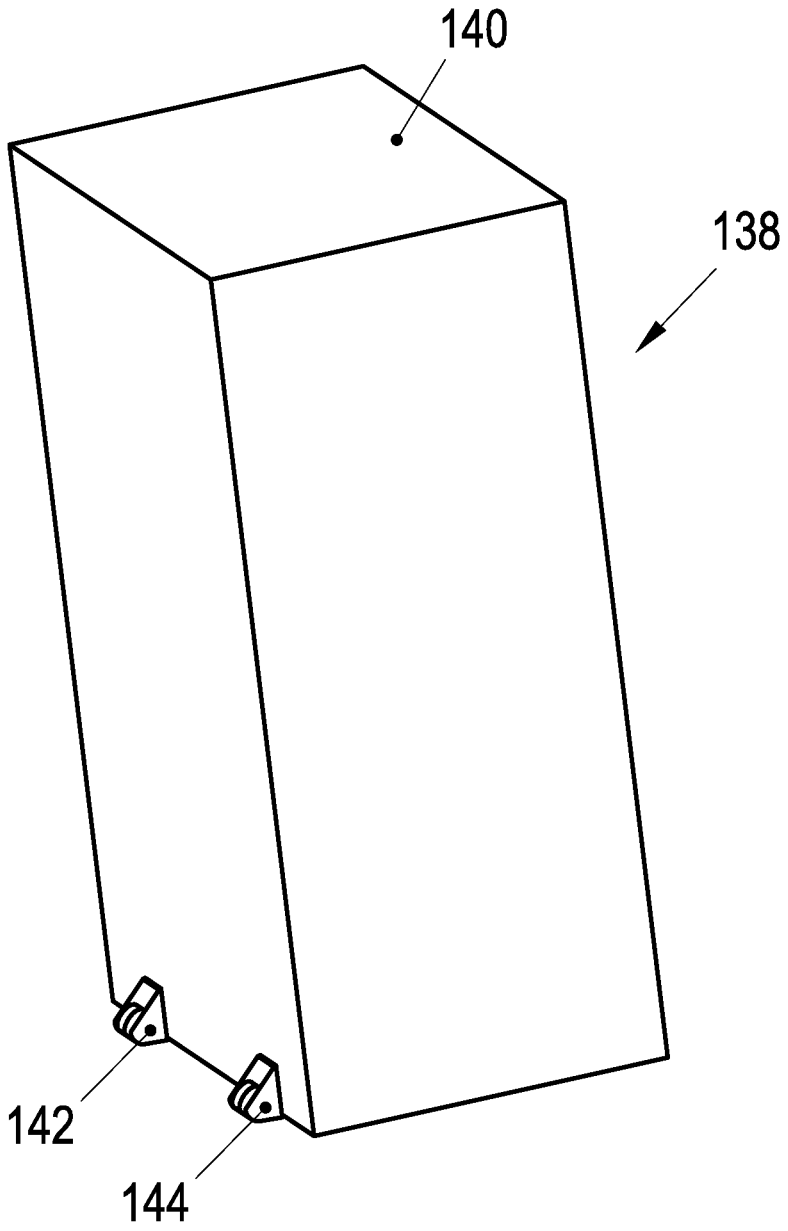
FIG. 26 shows a perspective view of the packaged, transport-ready storage and transport unit according to FIG. 25, and FIGS. 27A-27E show various kinematic phases during the adjustment of the calf support part in the embodiment according to FIG. 1.

FIG. 26 shows one embodiment in which the storage and transport unit 138 is accommodated in an outer container 140 made of cardboard, for example, to protect the wrapping from damage during transport and storage. In the illustrated embodiment, the rolling means has two laterally spaced-apart rollers 142, 144 that are affixed to the outer container 140. For this purpose, a holder for each of the rollers 142, 144 may be provided by means of a dowel or a pin-like fastening element that is pushed or driven into the outer container 140.

After transport to a user, the user may unpack the storage and transport unit 138 from the outer container 140 and remove the wrapping 134, whereby the cushion structure 130 of the mattress 128 re-expands and assumes its original state, and the support parts 110, 112 may be unfolded. In this state, the mattress 100 is then ready for use.

The method according to the invention allows a mattress to be easily and inexpensively prepared for storage or transport by forming a space-saving, compact storage and transport unit.

The functioning of the bracket 68 is explained in greater detail below with reference to FIG. 27A through FIG. 27E, which show various kinematic phases during the adjustment of the thigh support part 28 together with the calf support part 30. The calf support part 30 is connected to the thigh support part 28 via the pivot axis 32, without drive power, so that during pivoting of the thigh support part 28, the calf support part 30 under the effect of its weight force pivots relative to the thigh support part 28. Without additional measures, in an adjusted position the calf support part 30 would loosely move relative to the thigh support part 28 about the pivot axis 32. To avoid this, the calf support part 30 is fixed by the bracket 68 in an adjusted position relative to the thigh support part 28.

Figure 27A:
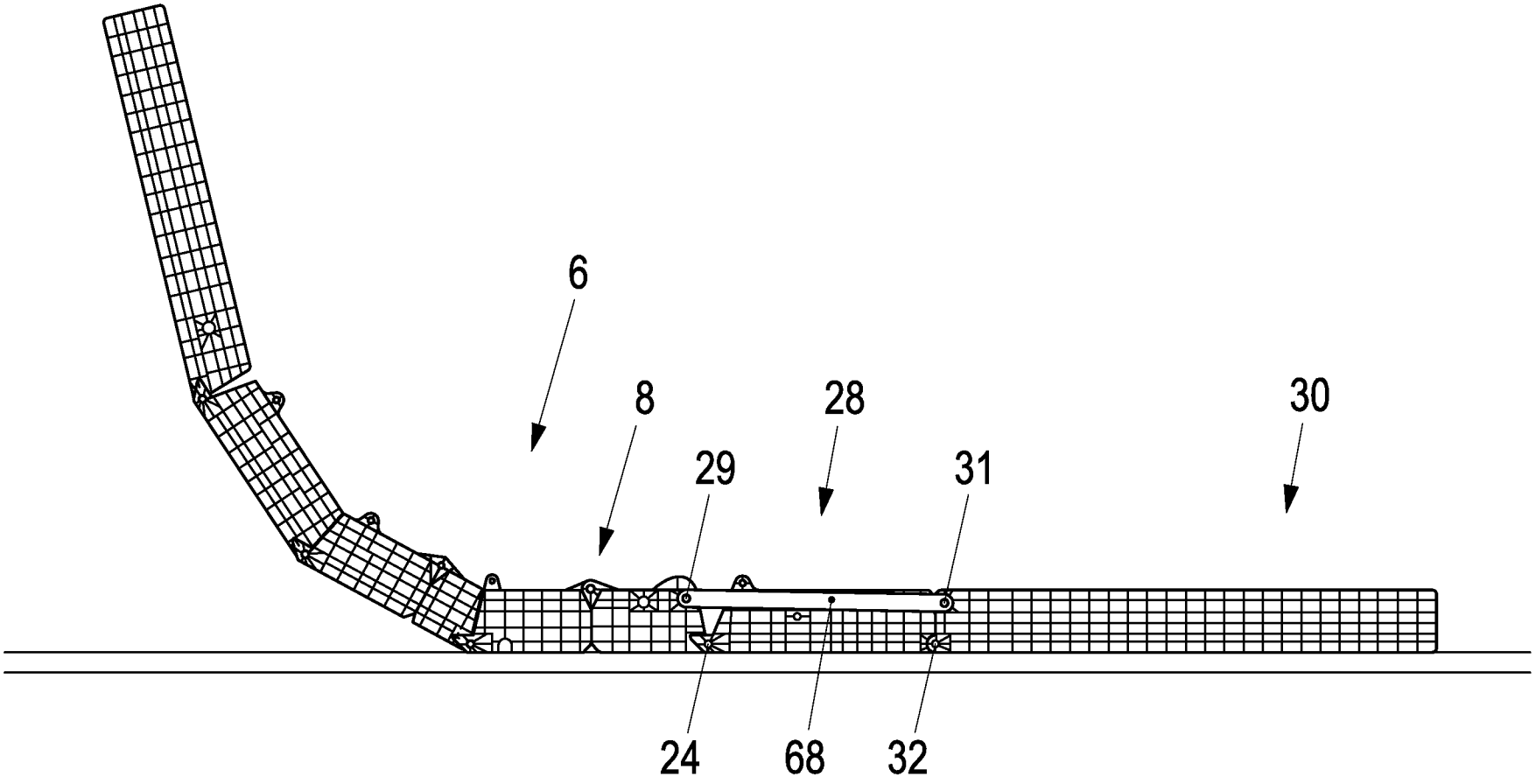

FIG. 27A shows the calf support part 30 together with the thigh support part 28 in an unadjusted starting position.

In the illustrated embodiment, the position of the hinge points 29, 31 is selected in such a way that, during an adjustment of the thigh support part 28 together with the calf support part 30 from an unadjusted starting position, in a first kinematic phase the calf support part 30 is initially lifted, and is not pivoted together with the thigh support part 28 until a second kinematic phase.

Figure 27B:
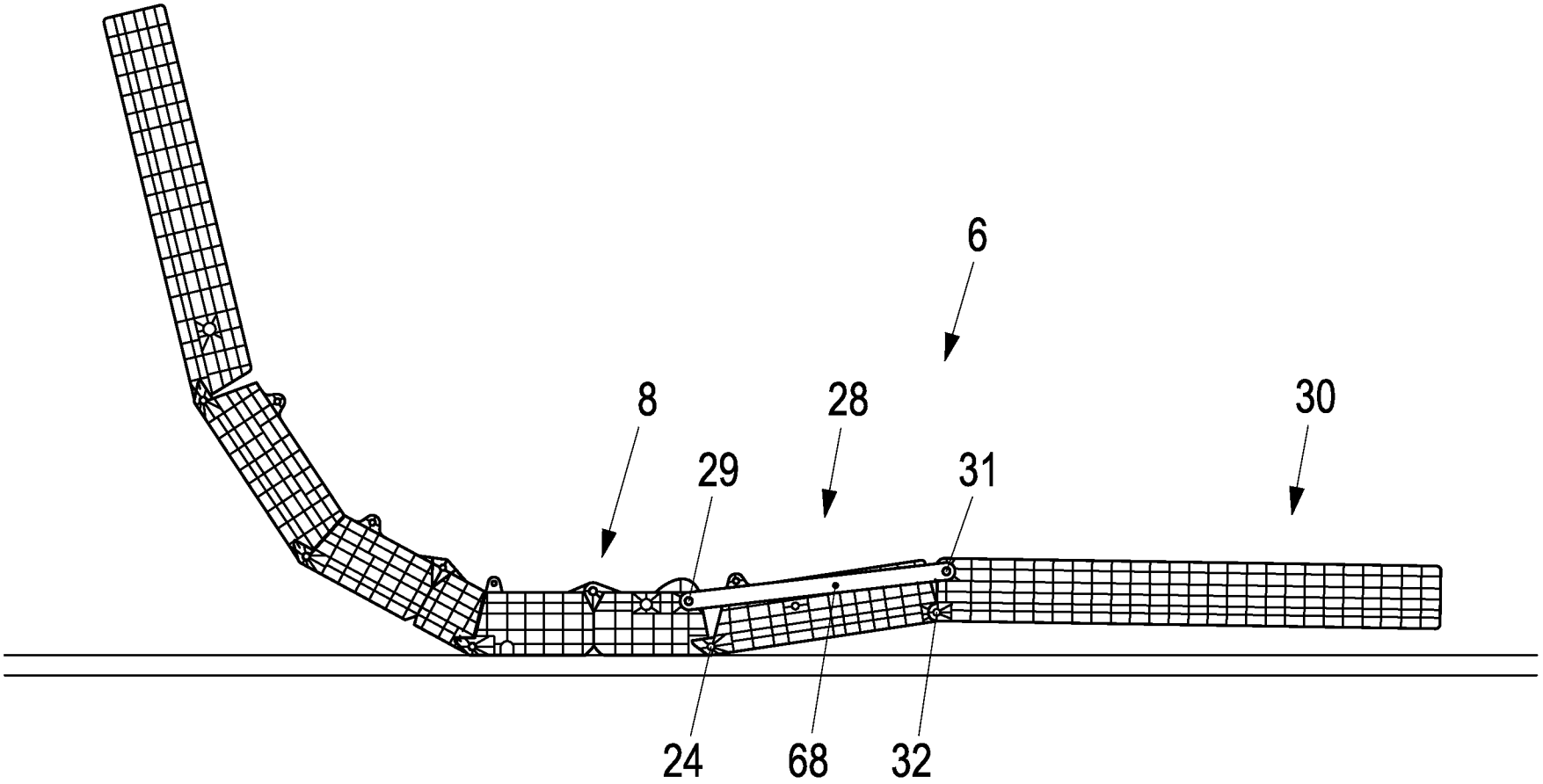

As illustrated in FIG. 27B, during pivoting of the upper body support part 28 the calf support part 30 is initially lifted (first kinematic phase).

Figure 27C:
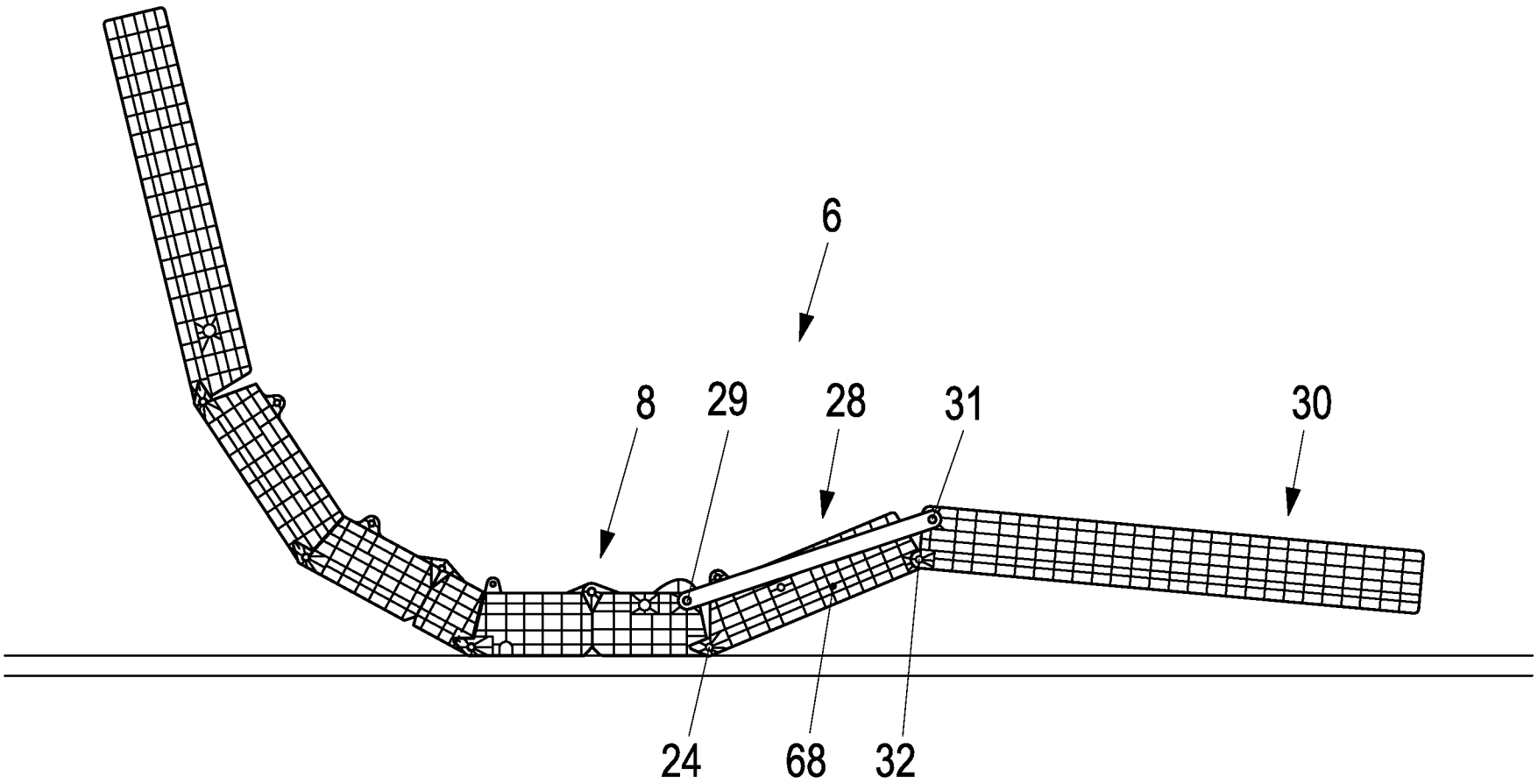
Figure 27D:
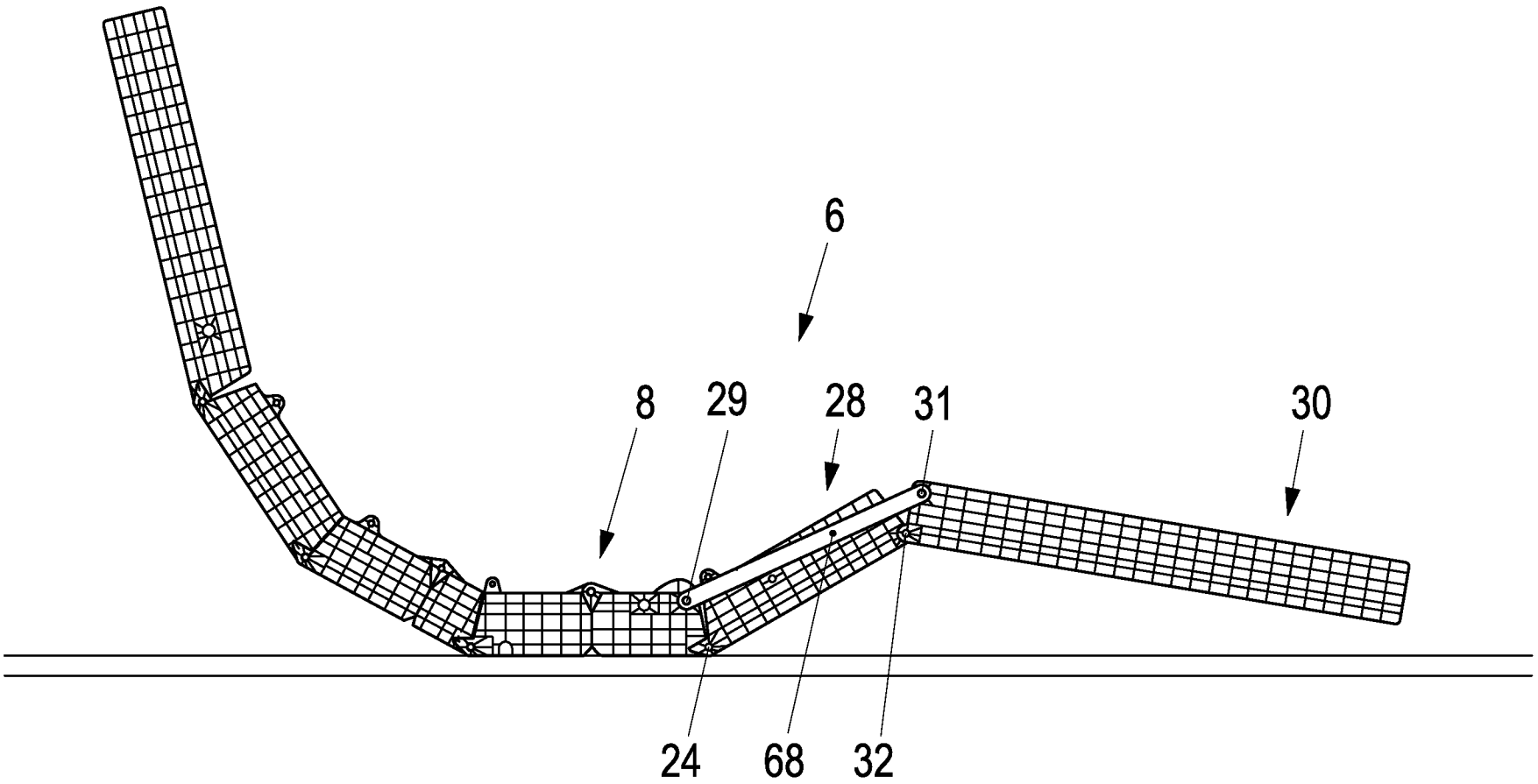

As illustrated in FIG. 27C and FIG. 27D, in a second kinematic phase the calf support part 30 is pivoted relative to the upper body support part 28.

Figure 27E:
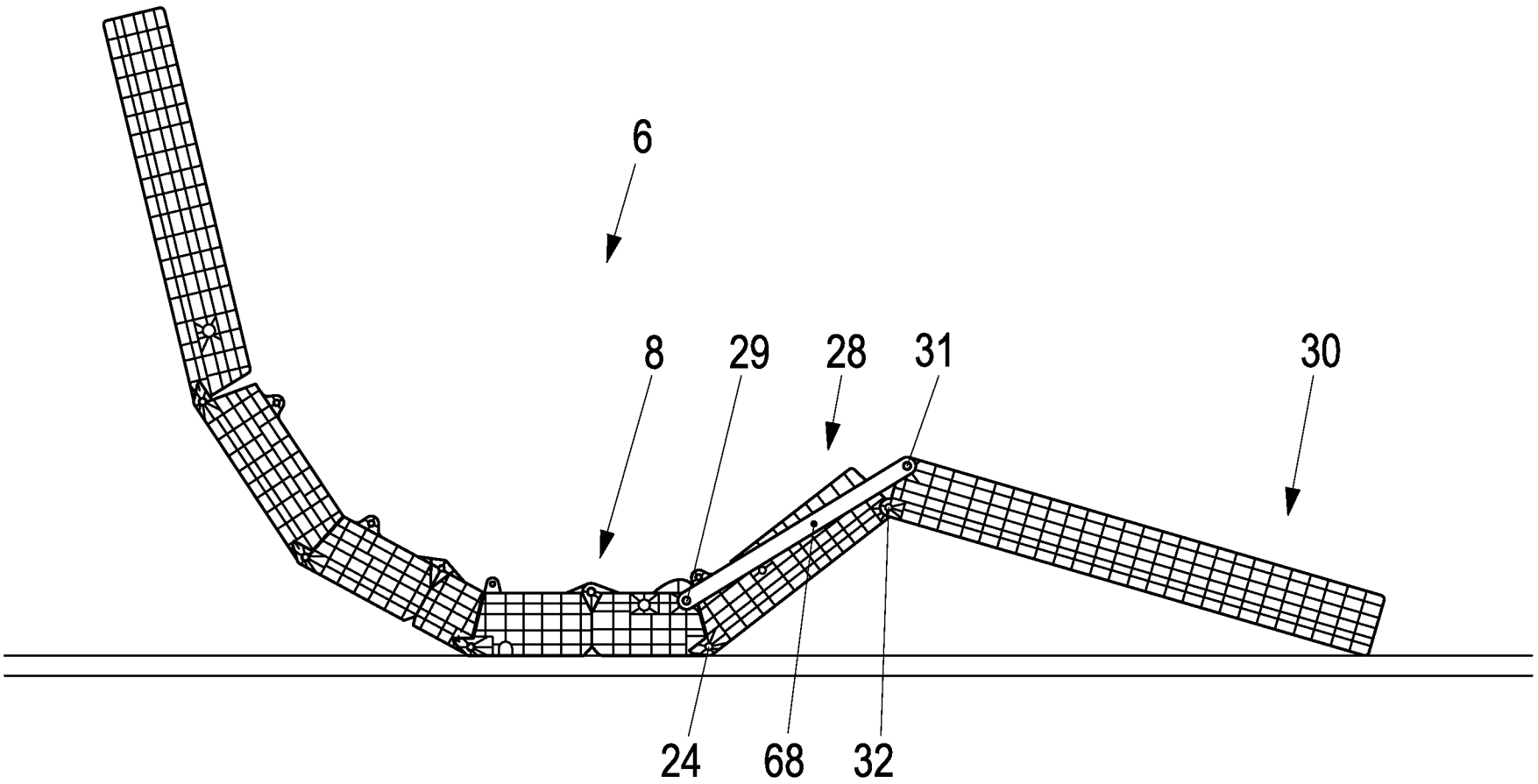

As is apparent from FIG. 27E, the kinematics of the adjustment movement are designed in such a way that the calf support part 30 is lowered once again at the end of the pivoting movement. FIG. 27E represents the end position of the adjustment movement, which corresponds to a maximum adjustment. As a result of the calf support part 30 being initially lifted at the beginning of the pivoting movement, excessive strain on the bottom side of the mattress 2 due to grinding on the floor is avoided.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. An electric motor driven adjustable mattress, comprising:

a) a shared casing in which at least one flat cushion element of a cushion structure and an electric motor driven adjustable support apparatus for supporting the cushion element are accommodated;

b) the support apparatus has at least two support parts that are adjustable relative to one another, and that on their sides facing the cushion element are provided with spring elements for elastically resiliently supporting the cushion element;

c) for adjusting the at least two support parts relative to one another, at least one electric motor driven drive apparatus is accommodated in the shared casing;

d) each of the at least two support parts of the support apparatus that are adjustable relative to one another are connected to one another via a pivot axis;

e) the at least two support parts have at least one middle support part, one end of which is connected to an upper body support part, and the other end of which is connected to a lower body support part; and f) the lower body support part has a thigh support part whose one end is articulatedly connected to the middle support part and pivotably drivable about a horizontal pivot axis, and whose other end is articulatedly connected to a calf support part and pivotable about a horizontal pivot axis in such a way that when the thigh support part pivots relative to the middle support part, the calf support part pivots relative to the thigh support part under the force of gravity, without drive power.

2. The mattress according to claim 1, wherein:

a) the electric motor driven drive apparatus has at least one output element which on the one hand is in drive connection with at least one electric motor, and which on the other hand is operatively connected to at least one Bowden cable that is operatively connected to the at least two support parts in such a way that the at least two support parts are adjustable or adjusted relative to one another under the traction effect of the Bowden cable.

3. The mattress according to claim 1, wherein:

a) the electric motor driven drive apparatus has a shared single electric motor for adjusting the upper body support part and the lower body support part, relative to the middle support part.

4. The mattress according to claim 3, wherein:

a) the shared single electric motor is operatively connected to the upper body support part and to the lower body support part in such a way that the adjustment of the upper body support part and of the lower body support part takes place in a time-delayed manner, during the adjustment movement.

5. The mattress according to claim 3, wherein:

a) the shared single electric motor is operatively connected to an individual output element of the electric motor driven drive apparatus.

6. The mattress according to claim 5, wherein:

a) two Bowden cables are associated with the upper body support part and with the lower body support part, and are in traction connection with at least one output element of the drive apparatus in such a way that when the respective output element moves, the Bowden cables associated with the upper body support part as well as the Bowden cables associated with the lower body support part are actuated.

7. The mattress according to claim 6, wherein:

a) the connection between the Bowden cables and the output element, and between the Bowden cables and the upper body support part and between the lower body support part, is formed in such a way that the adjustment of the upper body support part and of the lower body support part takes place in a time-delayed manner during the adjustment movement.

8. The mattress according to claim 7, wherein:

a) the adjustment of the upper body support part and of the lower body support part takes place in a time-delayed manner, at least in phases, during the adjustment movement.

9. The mattress according to claim 5, wherein:

a) the individual output element of the electric motor driven drive apparatus is linear movable.

10. The mattress according to claim 1, wherein:

a) the upper body support part is articulatedly connected to a pelvis support part and pivotable about a horizontal pivot axis, the pelvis support part with its end facing away from the upper body support part being connected to the middle support part and pivotable about a horizontal pivot axis.

11. The mattress according to claim 1, wherein:

a) the spring elements have a slat-like design.

12. The mattress according to claim 11, wherein:

a) the spring elements are made of plastic.

13. The mattress according to claim 1, wherein:

a) the pivot axes are situated in each case on the side of the at least two support parts facing away from the cushion element, perpendicularly with respect to a support surface of the support apparatus.

14. The mattress according to claim 1, wherein:

a) a means for fixing the calf support part relative to the thigh support part in the adjusted position is provided.

15. An electric motor driven adjustable mattress, comprising:

a) a shared casing in which at least one flat cushion element of a cushion structure and an electric motor driven adjustable support apparatus for supporting the cushion element are accommodated;

b) the support apparatus has at least two support parts that are adjustable relative to one another, and that on their sides facing the cushion element are provided with spring elements for elastically resiliently supporting the cushion element;

c) for adjusting the support parts relative to one another, at least one electric motor driven drive apparatus is accommodated in the shared casing; and d) at least one support part, in addition to the spring elements situated on the side facing the cushion element, is also provided with further spring elements on a side facing away from the cushion element, so that the support apparatus is provided, at least in sections, with spring elements on both sides along its longitudinal extension.

16. The mattress according to claim 15, wherein:

a) the cushion structure on the side of the support apparatus facing away from the cushion element has at least one further flat cushion element, so that the support apparatus is accommodated between the cushion elements in the manner of a sandwich.

17. An electric motor driven adjustable mattress, comprising:

a) a shared casing in which at least one flat cushion element of a cushion structure and an electric motor driven adjustable support apparatus for supporting the cushion element are accommodated;

b) the support apparatus has at least two support parts that are adjustable relative to one another, and that on their sides facing the cushion element are provided with spring elements for elastically resiliently supporting the cushion element;

c) for adjusting the support parts relative to one another, at least one electric motor driven drive apparatus is accommodated in the shared casino; and d) the support apparatus has at least two bending and folding axes that are spaced apart from one another along the longitudinal direction of the support apparatus and that are situated in such a way that for folding the mattress, the at least two support parts together with the cushion element or cushion elements situated thereon may be folded together, and in the folded state the extension of the mattress in its longitudinal direction is smaller than in the unfolded state.

18. The mattress according to claim 17, wherein:

a) at least one bending and folding axis is situated on the middle support part acid the pelvis support part, respectively.

19. The mattress according to claim 17, wherein:

a) at least one bending and folding axis is situated on a support part in such a way that the bending and folding axis divides the respective support part into two individual parts in the longitudinal direction of the mattress, which by means of the bending and folding axis are connected so as to be foldable relative to one another.

20. The mattress according to claim 17, wherein:

a) the bending and folding axes are situated in each case on a side of the at least two support parts facing the cushion element, perpendicularly with respect to a support surface of the support apparatus.

21. The mattress according to claim 17, wherein:

a) the at least two bending and folding axes are situated in such a way that the at least two support parts together with the cushion element or cushion elements situated thereon may be folded together in such a way that the at least two support parts in the folded state of the support apparatus define a U-like cross section.

* * * * *